US011603654B2

(12) United States Patent
Denissen

(10) Patent No.: US 11,603,654 B2
(45) Date of Patent: Mar. 14, 2023

(54) DRAIN CLEANING DEVICE

(71) Applicant: MILWAUKEE ELECTRIC TOOL CORPORATION, Brookfield, WI (US)

(72) Inventor: Ryan J. Denissen, Sussex, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 0 days.

(21) Appl. No.: 17/054,342

(22) PCT Filed: May 12, 2020

(86) PCT No.: PCT/US2020/032431

§ 371 (c)(1),
(2) Date: Nov. 10, 2020

(87) PCT Pub. No.: WO2020/231966

PCT Pub. Date: Nov. 19, 2020

(65) Prior Publication Data

US 2021/0197239 A1 Jul. 1, 2021

Related U.S. Application Data

(60) Provisional application No. 62/848,035, filed on May 15, 2019.

(51) Int. Cl.
*E03F 9/00* (2006.01)
*B08B 9/045* (2006.01)
(Continued)

(52) U.S. Cl.
CPC ..... *E03F 9/005* (2013.01); *B08B 9/045* (2013.01); *B65H 75/4484* (2013.01);
(Continued)

(58) Field of Classification Search
CPC ..... B08B 9/045; B08B 2209/04; E03F 9/00; E03F 9/002; E03F 9/005; E21B 19/008; E21B 19/22; B65H 75/4484; E03C 1/302
(Continued)

(56) References Cited

U.S. PATENT DOCUMENTS 1,842,166 A 1/1932 Haines
2,102,917 A 12/1937 Rolland
(Continued)

FOREIGN PATENT DOCUMENTS

CA 3021277 A1 4/2019
CN 2464800 Y 12/2004
(Continued)

OTHER PUBLICATIONS

Computer generated English Translation of DE 102006059559 A1, Greding, Jul. 2007. (Year: 2007).*
(Continued)

*Primary Examiner* — Laura C Guidotti
(74) *Attorney, Agent, or Firm* — Michael Best & Friedrich LLP

(57) ABSTRACT

A drain cleaning device includes a drum, and a cable positioned within the drum. The cable is operable to be extended out of the drum and into a conduit. The drain cleaning device also includes a motor coupled to the drum to rotate the drum, a sensor operable to detect a characteristic of the cable, and a controller coupled to the sensor and the motor. The controller is configured to receive a signal from the sensor indicative of the characteristic of the cable and send an instruction to the motor to change an operating parameter of the motor based on the signal received from the sensor.

18 Claims, 18 Drawing Sheets

(51) Int. Cl.
*B65H 75/44* (2006.01)
*B08B 13/00* (2006.01)
*E03C 1/302* (2006.01)

(52) U.S. Cl.
CPC ..... *E03F 9/002* (2013.01); *B08B 13/00* (2013.01); *B08B 2209/04* (2013.01); *E03C 1/302* (2013.01)

(58) Field of Classification Search
USPC ..... 15/104.31, 104.33
See application file for complete search history.

(56) References Cited

U.S. PATENT DOCUMENTS 2,111,527 A 3/1938 Blanc
2,167,268 A 7/1939 Sanger
2,223,005 A 11/1940 Kerber
2,225,129 A 12/1940 Osborn
2,244,735 A 6/1941 Silverman
2,267,493 A 12/1941 Clotz
2,282,600 A 5/1942 Blanc
2,291,253 A 7/1942 Osborn
2,297,755 A 10/1942 Faust
2,355,733 A 8/1944 Johnson et al.
2,426,265 A 8/1947 Gavin
2,468,490 A 4/1949 Di Joseph
2,504,391 A 4/1950 Carson
2,552,808 A 5/1951 O'Brien
2,562,574 A 7/1951 Poekert
2,610,807 A 9/1952 O'Brien
2,625,699 A 1/1953 Jurasevich
2,685,097 A 8/1954 Mien
2,730,740 A 1/1956 O'Brien
2,849,870 A 9/1958 Silverman
2,926,372 A 3/1960 O'Brien
2,926,775 A 3/1960 O'Brien
2,930,584 A 3/1960 Hensley et al.
2,953,799 A 7/1960 Arnold
2,955,307 A 10/1960 Hunt
2,960,851 A 11/1960 Ciaccio
3,007,186 A 11/1961 Olsson
3,025,547 A 3/1962 Ciaccio
3,071,794 A 1/1963 Prange
3,075,217 A 1/1963 Kollmann
3,078,486 A 2/1963 Casto et al.
3,083,391 A 4/1963 Prange
3,086,234 A 4/1963 Crane
3,093,854 A 6/1963 Silverman
3,095,592 A 7/1963 Hunt
3,159,861 A 12/1964 Sarcone
3,162,878 A 12/1964 Agostino
3,176,335 A 4/1965 Ciaccio et al.
3,206,782 A 9/1965 Larsen
3,213,473 A 10/1965 Singer
3,224,024 A 12/1965 Hunt
3,242,518 A 3/1966 Prange
3,246,354 A 4/1966 Cooney et al.
3,268,937 A 8/1966 Bollinger
3,298,051 A 1/1967 Ratliff
3,414,926 A 12/1968 Bloom
3,449,782 A 6/1969 Hunt
3,451,089 A 6/1969 Carlson et al.
3,451,090 A 6/1969 Lo Presti et al.
3,460,501 A 8/1969 Silverman
3,480,983 A 12/1969 Caperton
3,544,051 A 12/1970 Norman
3,574,878 A 4/1971 Shames et al.
3,605,158 A 9/1971 Russell
3,662,421 A 5/1972 Caperton
3,691,583 A 9/1972 Silverman et al.
3,703,015 A 11/1972 Naeve
3,727,261 A 4/1973 Levine
3,747,153 A 7/1973 O'Neill
3,882,565 A 5/1975 Irwin et al.
3,897,602 A 8/1975 Waterbury
3,928,885 A 12/1975 Peterson et al.
3,950,934 A 4/1976 Irwin
3,958,293 A 5/1976 Irwin
3,983,593 A 10/1976 Naeve
4,104,757 A 8/1978 Silverman
4,153,966 A 5/1979 Irwin
4,188,683 A 2/1980 Klunder
4,218,802 A 8/1980 Babb et al.
4,246,802 A 1/1981 Rasmussen et al.
4,266,709 A 5/1981 Kruger
4,284,931 A 8/1981 Ehret
4,290,162 A 9/1981 Agostino
4,356,557 A 10/1982 Bell et al.
4,364,139 A 12/1982 Babb et al.
4,395,791 A 8/1983 Irwin
D271,436 S 11/1983 Babb et al.
4,420,852 A 12/1983 Bowlsby
4,464,806 A 8/1984 Prange
4,540,017 A 9/1985 Prange
4,570,281 A 2/1986 Boelens
4,580,306 A 4/1986 Irwin
4,611,360 A 9/1986 Irwin
4,617,693 A 10/1986 Meyer et al.
D287,178 S 12/1986 Babb et al.
4,686,732 A 8/1987 Irwin
4,700,422 A 10/1987 Russell
4,716,613 A 1/1988 Irwin
4,734,951 A 4/1988 Prange
4,763,374 A 8/1988 Kaye
4,773,113 A 9/1988 Russell
4,793,017 A 12/1988 Kaye
4,878,517 A * 11/1989 Prange ..... B05B 12/06 137/355.12
D307,202 S 4/1990 Moss
4,914,775 A 4/1990 Kirk
4,916,772 A 4/1990 Russell et al.
4,925,214 A 5/1990 Hazelton et al.
D310,280 S 8/1990 Moss
4,956,889 A 9/1990 Kirk
4,989,323 A 2/1991 Casper et al.
5,009,242 A 4/1991 Prange
5,029,356 A 7/1991 Silverman et al.
5,031,263 A 7/1991 Babb et al.
5,031,276 A 7/1991 Babb et al.
5,130,707 A 7/1992 Hagen
5,193,242 A 3/1993 Irwin
5,195,392 A 3/1993 Moore et al.
5,199,129 A 4/1993 Salecker et al.
5,222,270 A 6/1993 Sloter et al.
5,235,718 A 8/1993 Grimsley et al.
5,239,724 A 8/1993 Salecker et al.
5,251,356 A 10/1993 Oaki et al.
5,283,922 A 2/1994 Ruprecht
5,309,595 A 5/1994 Salecker et al.
5,365,874 A 11/1994 Dorfman
5,390,389 A 2/1995 Rutkowski et al.
5,414,888 A 5/1995 Irwin
5,419,349 A 5/1995 Swain
5,426,807 A 6/1995 Grimsley et al.
5,507,062 A 4/1996 Salecker
5,526,975 A 6/1996 Endo
5,603,136 A 2/1997 Truschler
5,622,319 A 4/1997 Babb et al.
5,636,403 A 6/1997 Grimsley et al.
5,640,736 A 6/1997 Salecker
5,657,505 A 8/1997 Gallagher et al.
5,661,265 A 8/1997 Yarbrough et al.
5,689,980 A 11/1997 Weinerman et al.
5,816,165 A 10/1998 Huston
5,862,561 A 1/1999 Irwin
5,901,401 A 5/1999 Rutkowski et al.
5,924,566 A 7/1999 Gibbs
5,987,684 A 11/1999 Evans
5,996,159 A 12/1999 Irwin
6,009,588 A 1/2000 Rutkowski
6,076,219 A 6/2000 Irwin
6,158,076 A 12/2000 Rutkowski et al.
6,243,905 B1 6/2001 Rutkowski

(56) References Cited

U.S. PATENT DOCUMENTS 6,343,398 B1 2/2002 Silverman et al.
6,360,397 B1 3/2002 Babb
6,381,798 B1 5/2002 Rutkowski et al.
6,412,136 B1 7/2002 Rutkowski
6,470,525 B1 10/2002 Silverman
6,546,582 B2 4/2003 Silverman
6,594,849 B1 7/2003 Nimens
6,615,436 B1 9/2003 Burch, Jr. et al.
6,618,891 B2 9/2003 Schmitt
6,618,892 B2 9/2003 Schmitt
6,637,064 B2 10/2003 Silverman et al.
6,655,228 B1 12/2003 Margherio et al.
6,745,487 B1 6/2004 Nield
6,760,948 B2 7/2004 Schmitt
6,898,881 B2 5/2005 Morrison
D509,929 S 9/2005 Rutkowski et al.
7,007,399 B2 3/2006 Catalano
7,070,044 B2 7/2006 Rosenfeld
7,073,224 B2 7/2006 Schmitt
7,137,503 B2 11/2006 Chesack et al.
7,222,383 B2 5/2007 Hale
7,269,874 B2 9/2007 Hung
7,367,077 B2 5/2008 Rutkowski et al.
D570,558 S 6/2008 Rutkowski et al.
D579,612 S 10/2008 Rutkowski et al.
D582,108 S 12/2008 Duff et al.
7,478,451 B2 1/2009 Rutkowski et al.
D595,911 S 7/2009 Rutkowski et al.
7,676,879 B1 3/2010 Rutenberg et al.
7,685,669 B2 3/2010 Rutkowski et al.
7,729,792 B2 6/2010 Lucas et al.
7,757,332 B1 7/2010 Hale
7,793,608 B1 9/2010 Udouj
7,806,256 B2 10/2010 Wildauer et al.
7,810,203 B2 10/2010 Stoltz
7,889,980 B2 2/2011 Sooy
7,891,038 B2 2/2011 Hale
7,935,192 B2 5/2011 Silverman et al.
7,988,157 B2 8/2011 Rembos et al.
8,046,862 B2 11/2011 Eisermann et al.
8,060,868 B2 11/2011 Babb et al.
8,060,968 B2 11/2011 Babb et al.
8,176,593 B2 5/2012 Gress et al.
8,302,491 B2 11/2012 Stack
8,413,347 B2 4/2013 Gress et al.
8,434,186 B2 5/2013 Wildauer et al.
8,539,618 B2 9/2013 Gibson et al.
8,578,949 B2 11/2013 Kalbfeld et al.
8,615,837 B2 12/2013 Hale et al.
8,646,143 B2 2/2014 Lokkinen
8,662,092 B2 3/2014 Kalbfeld et al.
8,826,483 B2 9/2014 Rutkowski et al.
8,899,554 B2 12/2014 Wong et al.
8,931,131 B1 1/2015 Feduke
8,970,211 B1 3/2015 Olsson et al.
9,009,906 B2 4/2015 Hale et al.
9,015,890 B1 4/2015 Owens
9,041,794 B1 5/2015 Olsson et al.
9,234,342 B1 1/2016 Beesley et al.
9,260,847 B2 2/2016 Silverman et al.
9,468,954 B1 10/2016 Olsson et al.
9,550,649 B2 1/2017 Zink
9,592,890 B2 3/2017 Christensen et al.
10,071,401 B2 9/2018 Dunkin et al.
10,189,060 B2 1/2019 Hsu
10,493,901 B2 12/2019 Schermerhorn et al.
11,434,103 B2 * 9/2022 Dion ..... B65H 75/4484
2002/0083538 A1 7/2002 Silverman et al.
2002/0189038 A1 12/2002 Silverman
2004/0231723 A1 11/2004 Harrington et al.
2004/0255415 A1 12/2004 Silva
2005/0087644 A1 4/2005 Kim
2005/0173277 A1 8/2005 Rich
2005/0193509 A1 9/2005 Rutkowski et al.
2005/0246846 A1 11/2005 Rutkowski et al.
2006/0027155 A1 2/2006 Welch
2006/0195994 A1 9/2006 Hung
2006/0249185 A1 11/2006 Garman
2007/0033752 A1 2/2007 Hung
2007/0089254 A1 4/2007 Maine
2008/0098544 A1 5/2008 Rutkowski et al.
2008/0148503 A1 6/2008 Babb et al.
2008/0244816 A1 10/2008 Babb et al.
2008/0313831 A1 12/2008 Kovach et al.
2009/0211044 A1 8/2009 Hale et al.
2009/0292502 A1 11/2009 Gress et al.
2010/0005603 A1 1/2010 Liu
2010/0017981 A1 1/2010 Hamm et al.
2010/0050350 A1 3/2010 Babb et al.
2010/0125959 A1 5/2010 Sooy
2010/0127922 A1 5/2010 Sooy
2010/0139696 A1 6/2010 Silverman et al.
2010/0294872 A1 11/2010 Wang
2011/0182656 A1 7/2011 Babb
2011/0284024 A1 * 11/2011 Trebel ..... A46B 13/04 134/1
2012/0203501 A1 8/2012 Gress et al.
2013/0105749 A1 5/2013 Gaillard
2013/0160227 A1 6/2013 Rutkowski et al.
2013/0160583 A1 6/2013 Kai et al.
2014/0202492 A1 7/2014 Grossman et al.
2014/0223679 A1 8/2014 Silverman et al.
2014/0230181 A1 8/2014 Yamaoka et al.
2014/0352464 A1 12/2014 Zink
2016/0175899 A1 6/2016 Dunkin et al.
2017/0165723 A1 6/2017 Banholzer et al.
2017/0284078 A1 10/2017 Puzio et al.
2017/0304879 A1 10/2017 Hsu
2018/0016776 A1 1/2018 Stoneback et al.
2018/0030715 A1 2/2018 Miller et al.
2018/0057385 A1 3/2018 Bray, III
2018/0080212 A1 3/2018 Cole et al.
2018/0147612 A1 5/2018 Kehoe et al.
2018/0169719 A1 6/2018 Turner et al.

FOREIGN PATENT DOCUMENTS

CN 101180139 A 5/2008
CN 102036759 B 4/2011
CN 203049728 U 7/2013
CN 203270721 U 11/2013
CN 203346973 U 12/2013
CN 104120767 A 10/2014
CN 204482269 7/2015
CN 204738359 U 11/2015
CN 204980665 U 1/2016
DE 2244206 C2 3/1974
DE 3221245 A1 12/1983
DE 3423464 1/1986
DE 19739359 A1 5/1999
DE 10227204 B4 1/2004
DE 10248411 4/2004
DE 102006059559 A1 * 7/2007 ..... B08B 9/045
DE 102006006602 A1 8/2007
DE 102008015532 A1 10/2009
DE 202008018563 U1 11/2015
DE 202014011027 U1 10/2020
EP 0607612 A1 7/1994
EP 1818114 B1 8/2007
EP 2371462 B1 10/2011
GB 1118126 A 6/1968
JP H11300305 A 11/1999
JP 2001182148 A 7/2001
JP 2007054738 A 3/2007
KR 20150115509 A 10/2015
KR 20160143309 A 12/2016
NL 9100342 A 9/1992
WO 2006112847 A1 10/2006
WO 2006112848 10/2006
WO 2008079702 A2 7/2008
WO 2009143497 A2 11/2009
WO 2016141923 A1 9/2016

(56) References Cited

FOREIGN PATENT DOCUMENTS

OTHER PUBLICATIONS

Computer generated English Transition of JP 2001-182148 A, Osanai, Jul. 2001. (Year: 2001).*
https://www.mytana.com/product/m745-variable-speed-cable-machine-with-smartdrive/.
International Search Report and Written Opinion for Application No. PCT/US2020/032431 dated Aug. 20, 2020 (12 pages).
Mytana, "M500 User Guide", available in 2009, 4 pages.
Ridgid, "K-45 Drain Cleaning Machine Manual", available in 2012, 55 pages.
Ridgid, "K-45 Drain Cleaning Machine Parts List", available in 2012, 2 pages.

* cited by examiner

DRAIN CLEANING DEVICE

CROSS REFERENCE TO RELATED APPLICATIONS

This application is a national phase filing under 35 U.S.C. 371 of International Application No. PCT/US2020/032431, filed May 12, 2020, which claims priority to U.S. Provisional Patent Application Ser. No. 62/848,035, filed on May 15, 2019, the entire contents of which are incorporated by reference herein.

BACKGROUND OF THE INVENTION

The present application relates to drain cleaning devices for cleaning drains, pipes, or other conduits, and specifically, to a control system for a drain cleaning device.

Drain cleaning devices are used to clean clogs and debris out of drains, sewers, and the like. Typically, the drain cleaning device includes a drum that stores a cable. When the drum is rotated (e.g., via a motor or manually by a handle) friction between an inner surface of the drum and the cable causes the cable to spin to facilitate clearing debris from a drain, pipe, or another conduit. Drain cleaning devices are heavy and cumbersome to use, making them challenging for inexperienced users to operate. If proper technique is not used, the cables can become fouled, ratsnested, or even break in the pipe.

SUMMARY

In one embodiment, the invention provides a drain cleaning device including a drum, and a cable positioned within the drum. The cable is operable to be extended out of the drum and into a conduit. The drain cleaning device also includes a motor coupled to the drum to rotate the drum, a sensor operable to detect a characteristic of the cable, and a controller coupled to the sensor and the motor. The controller is configured to receive a signal from the sensor indicative of the characteristic of the cable and send an instruction to the motor to change an operating parameter of the motor based on the signal received from the sensor.

In another embodiment, the invention provides a method of operating a drain cleaning device. The method includes providing the drain cleaning device having a drum, a cable positioned within the drum, a motor coupled to the drum, a sensor, and a controller coupled to the sensor and the motor, rotating the drum with the motor to spin the cable, extending the cable out of the drum and into a conduit, detecting, by the sensor, a characteristic of the cable, and changing, by the controller, an operating parameter of the motor based on the characteristic detected by the sensor.

In another embodiment, the invention provides a drain cleaning device including a drum, a cable positioned within the drum, a motor coupled to the drum to rotate the drum, a cable feed device operable to extend the cable out of the drum and retract the cable into the drum, a sensor operable to detect a performance characteristic of the drain cleaning device, and a controller coupled to the sensor and to the motor, the cable feed device, or both. The controller is configured to receive a signal from the sensor indicative of the performance characteristic of the drain cleaning device, and send an instruction to the motor, the cable feed device, or both to change an operating parameter of the motor, the cable feed device, or both based on the signal received from the sensor.

In another embodiment, the invention provides a method of operating a drain cleaning device. The method includes providing the drain cleaning device having a drum, a cable positioned within the drum, a motor coupled to the drum, a cable feed device, a sensor, and a controller coupled to the sensor and to the motor, the cable feed device, or both, rotating the drum with the motor to spin the cable, extending the cable out of the drum, by the cable feed device, and into a conduit, detecting, by the sensor, a performance characteristic of the drain cleaning device as the cable is extended into the conduit, and changing, by the controller, an operating parameter of the motor, the cable feed device, or both based on the performance characteristic detected by the sensor.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

FIGS. 1-4 illustrate a drain cleaning device (e.g., a drain cleaner) 1200 including a frame 1210, a drum housing 1214, a motor housing 1218, a power supply 1222, and powered tracks 1226. The frame 1210 includes a handle 1230, a base 1234 that supports the drum housing 1214, and wheels 1238. A drum 1242 is rotatably supported within the drum housing 1214 and includes a cable 1244 (FIG. 5) that is extendable out of an opening 1246 on the drum 1242. In some embodiments, the drum 1242 is a cage-style drum that when the drum housing 1214 is opened allows easy access to the cable 1244 so a user can inspect the cable 1244. The cable 1244 is extendable out of the drum with a cable feed device 1250. A first motor 1254 is supported within the motor housing 1218 and is coupled to the drum 1242. The first motor 1254 is operable to rotate the drum 1242. Rotation of the drum 1242 creates friction between an inner surface of the drum 1242 and the cable 1244, which causes the cable 1244 to spin to facilitate clearing debris from a drain pipe or another conduit. In some embodiments, the cable 1244 may be a coiled or wound metal. In other embodiments, the cable 1244 may be other types of cables. In further embodiments, the diameter of the cable 1244 may vary.

Figure 3:
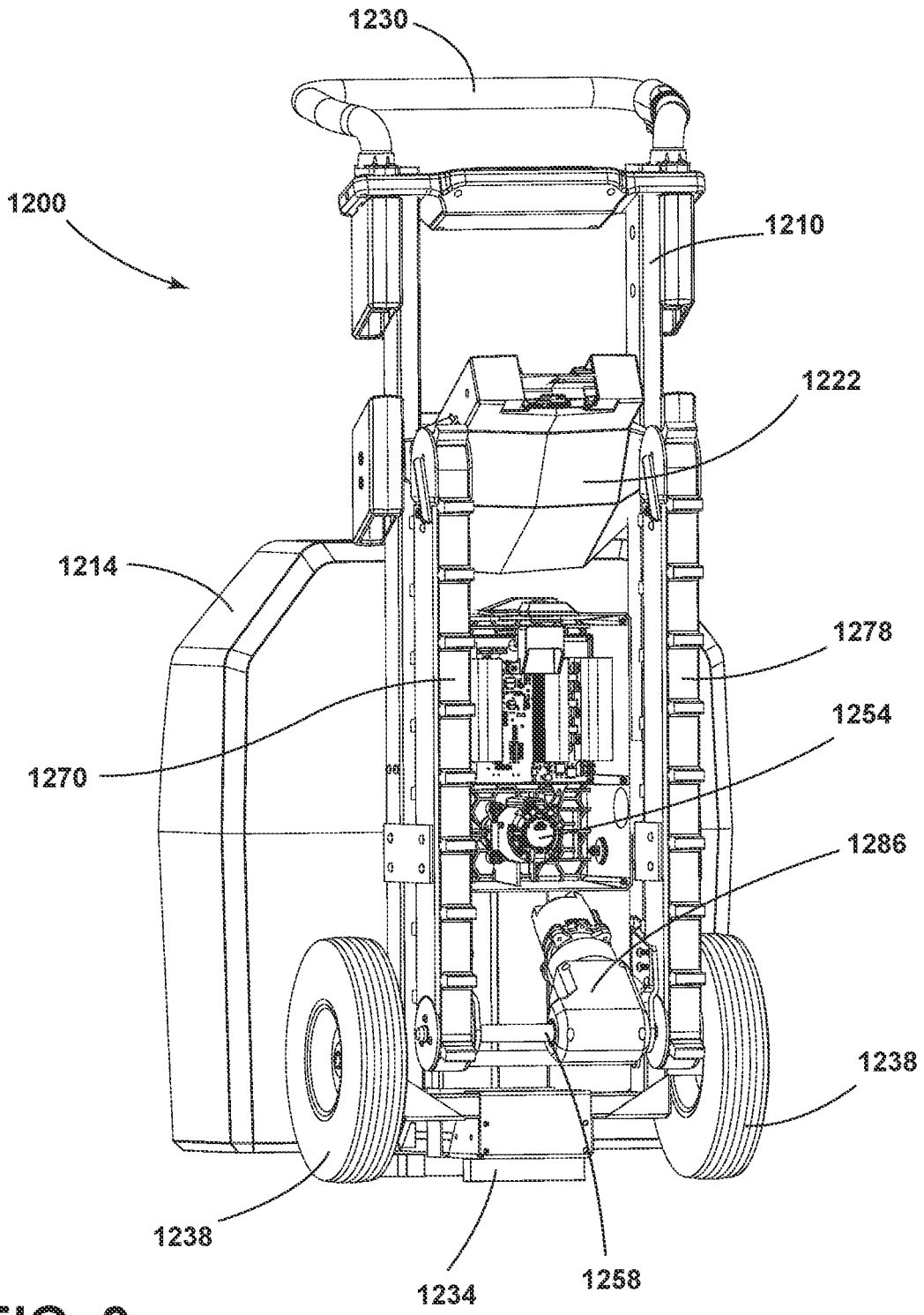
FIG. 3 is a rear perspective view of the drain cleaning device of FIG. 1 with a motor housing removed.

As shown in FIG. 3, the powered tracks 1226 includes a first track 1270, a second track 1278, and a drive shaft 1258 connecting the first and second tracks 1270, 1278. A second motor 1286 is supported by the frame 1210 and is coupled to the drive shaft 1258 of the powered tracks 1226. The second motor 1286 is operable to rotate the drive shaft 1258 and thus the first and second tracks 1270, 1278. In the illustrated embodiment, both the first and second motors 1254, 1286 are powered by the power supply 1222 that is supported on the frame 1210. In alternative embodiments, the first and second motors 1254, 1286 are brushless motors. In additional embodiments, the first and second motors 1254, 1286 are variable two speed motors. In some embodiments, the power supply 1222 may be coupled to a power outlet to provide A/C power to the drain cleaning device 1200. In other embodiments, the power supply 1222 may include a battery receptacle that receives a battery pack to provide D/C power to the drain cleaning device 1200. In further embodiments, the power supply 1222 may receive more than one battery pack to power the drain cleaning device 1200.

In the illustrated embodiment, the cable feed device 1250 is removably coupled to the opening 1246 with fasteners. The cable feed device 1250 includes a housing 1290 and a handle 1294. The handle 1294 is rotatable to put the cable feed device 1250 in either a payout mode or a retract mode. By rotating the handle 1294 clockwise, the cable feed device 1250 is set to the payout mode to pay out cable 1244 from within the drum 1242. By rotating the handle 1294 counterclockwise, the cable feed device 1250 is set to the retract mode and begins to retract the cable 1244 back into the drum 1242. The handle 1294 may also be positioned in a neutral position to allow manual pay out of the cable 1244.

Figure 2:
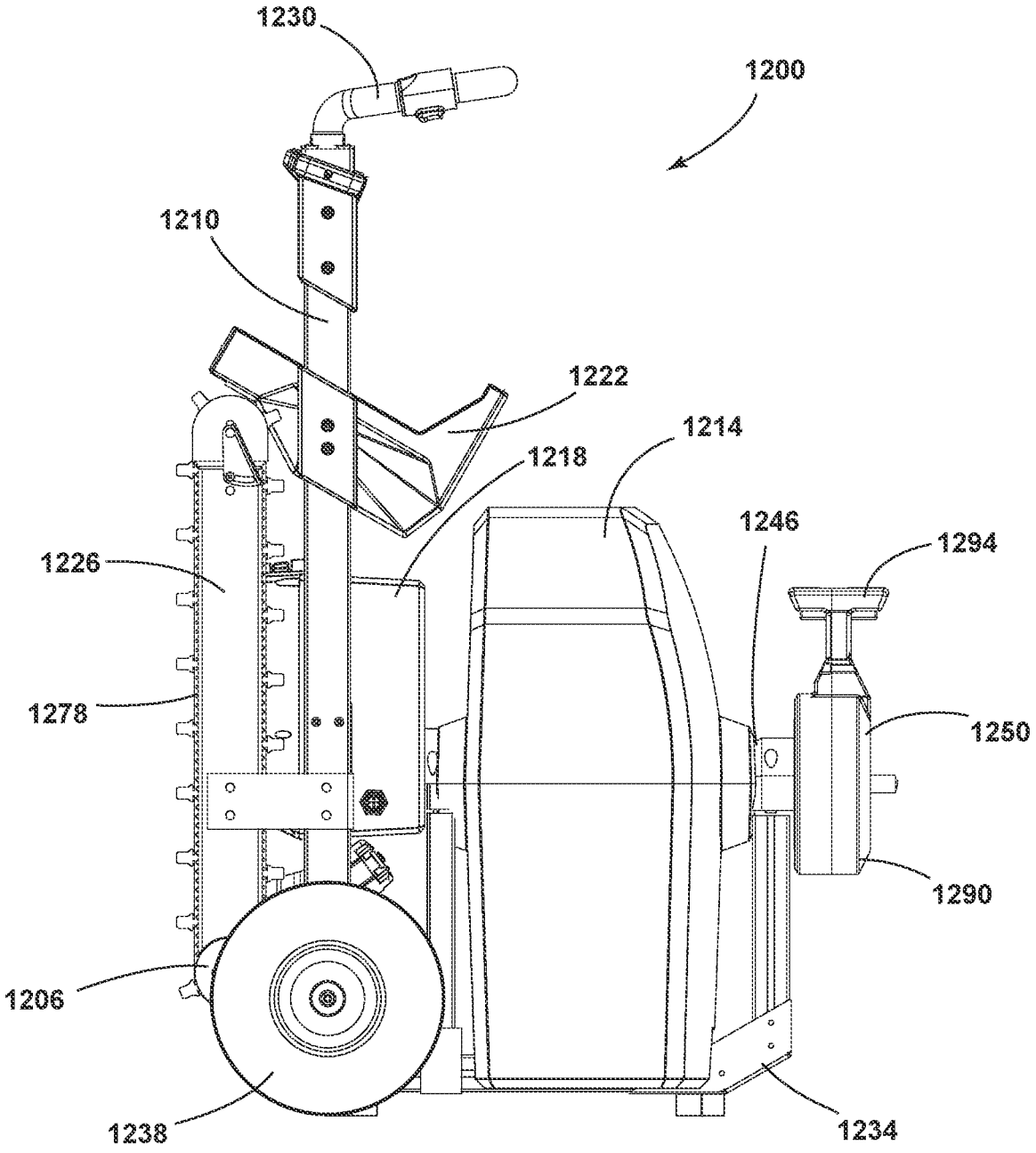
FIG. 2 is a side view of the drain cleaning device of FIG. 1.
Figure 4:
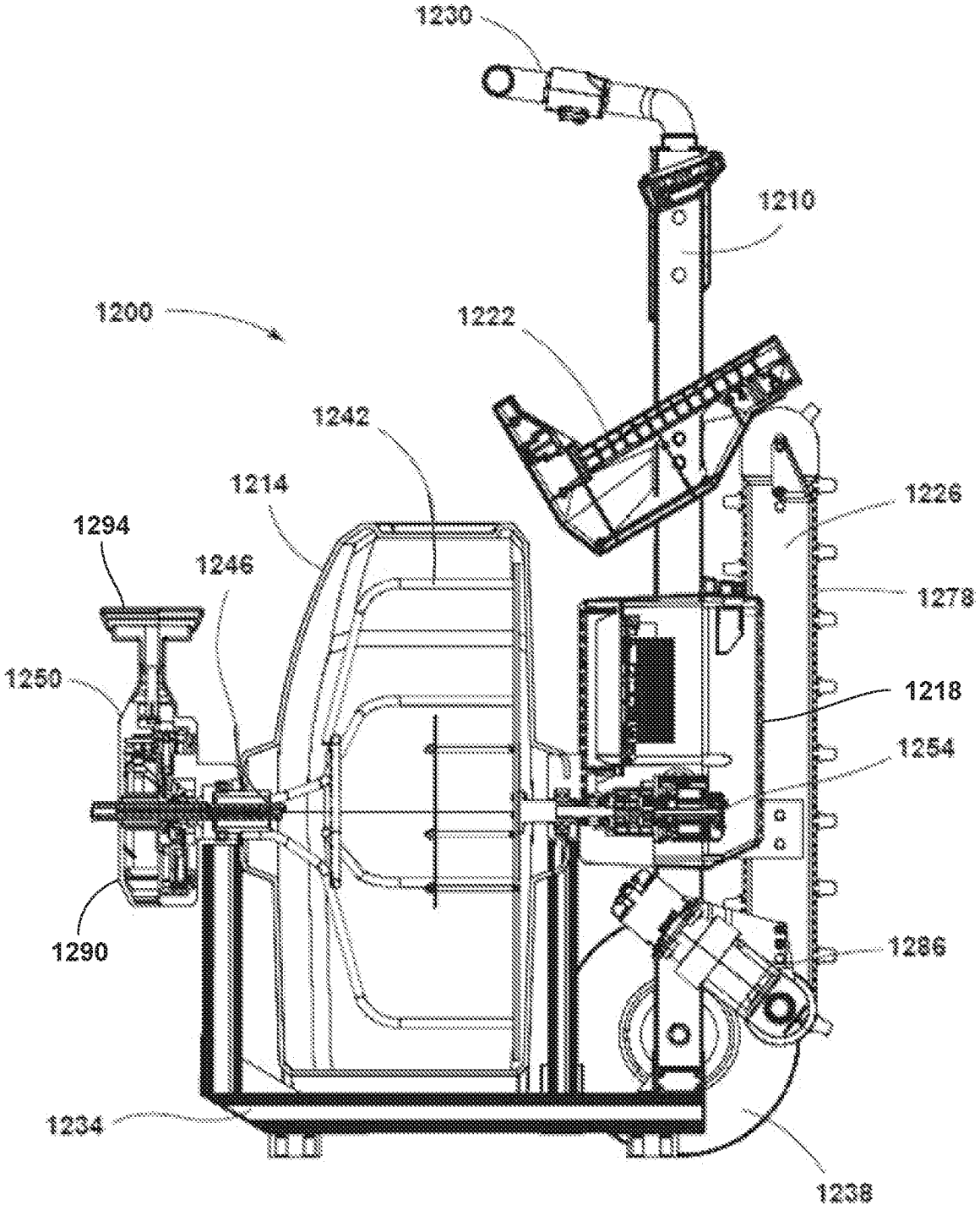
FIG. 4 is a cross-sectional view of the drain cleaning device of FIG. 1.

With reference to FIGS. 2-4, the drain cleaning device 1200 is shown in a first operational position. In this position, the drum housing 1214 of the drain cleaning device 1200 is supported on a surface to facilitate the clearing of debris from a conduit. In operation, the power supply 1222 supplies power to the first motor 1254 to spin the drum 1242. The cable feed device 1250 draws the cable 1244 from inside the drum 1242 so that a user may extend the cable 1244 into a drain. Rotation of the drum 1242 causes the cable 1244 to spin assisting in the removal of debris from the drain.

Figure 1:
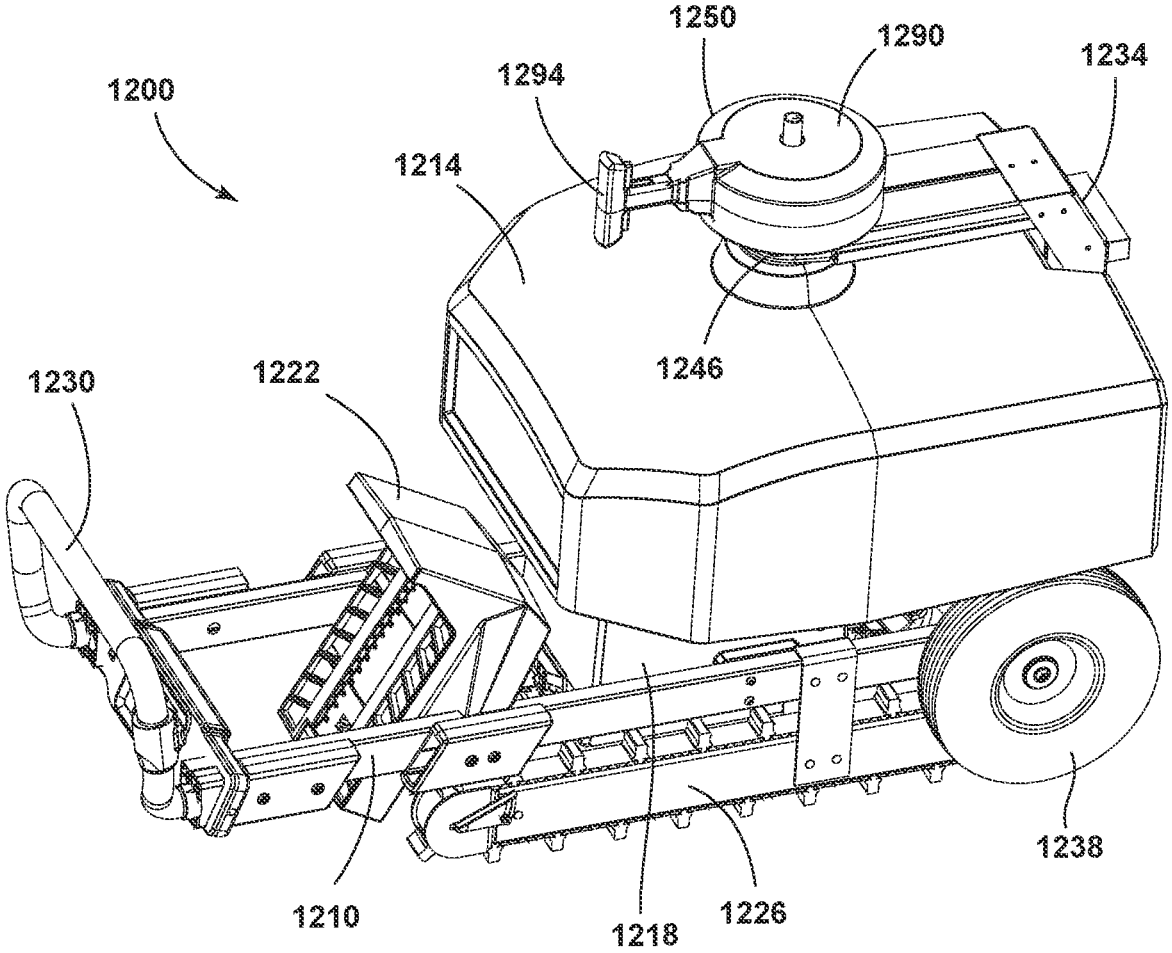
FIG. 1 is a front perspective view of a drain cleaning device.

With reference to FIG. 1, the drain cleaning device 1200 is shown in a second transport position. A user may tilt the frame 1210, lifting the housing 1214 off of a surface and allowing the wheels 1238 to transport the drain cleaning device 1200 along the surface. However, due to the weight, the drain cleaning device 1200 may be difficult to lift. Specifically, a user may have difficulty transporting the drain cleaning device 1200 on stairs. During transportation, the power tracks 1226 may assist in lifting the drain cleaning device 1200 both up and down stairs. Additionally, the power tracks 1226 may assist in lifting the drain cleaning device 1200 into the bed of a truck.

Figure 5:
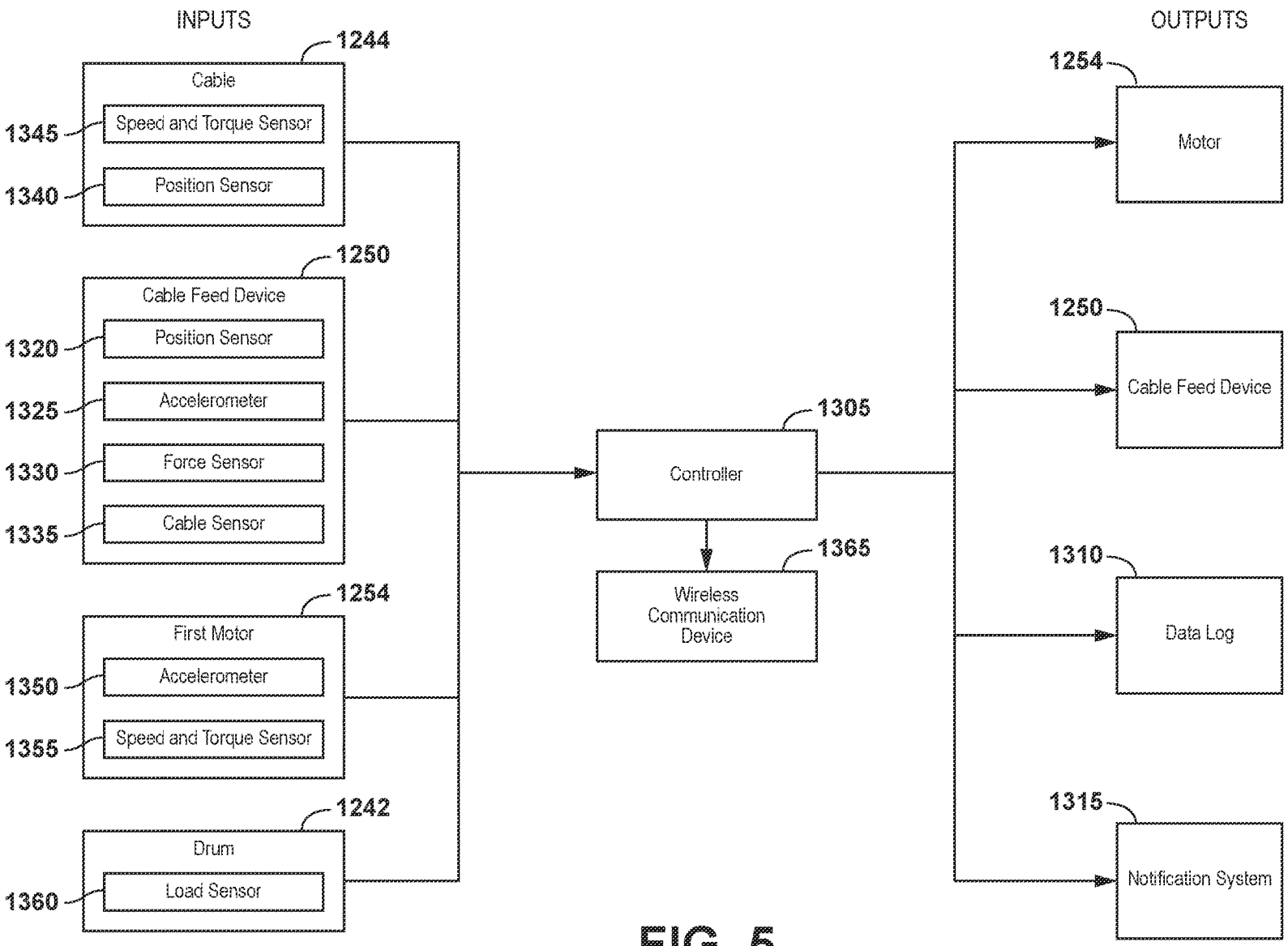
FIG. 5 is a schematic diagram of a control system for the drain cleaning device of FIG. 1.

As shown in FIG. 5, the drain cleaning device 1200 includes a control system 1300 including a controller 1305 or processor that controls operation of the drain cleaning device 1200. In some embodiments, the controller 1305 is implemented as a microprocessor with separate memory. In other embodiments, the controller 1305 may be implemented as a microcontroller (with memory on the same chip). In other embodiments, the controller 1305 may be implemented using multiple processors. In addition, the controller 1305 may be implemented partially or entirely as, for example, a field-programmable gate array (FPGA), an application specific integrated circuit (ASIC), and the like, and the memory may not be needed or be modified accordingly. The memory may include non-transitory, computer readable memory that stores instructions that are received and executed by the controller 1305 to carry out functionality of the drain cleaning device 1200 described herein. The memory may include, for example, a program storage area and a data storage area. The program storage area may include combinations of different types of memory, such as read-only memory and random-access memory.

In the illustrated embodiment, the controller 1305 receives an input or a signal indicative of performance characteristics of the drain cleaning device 1200. Specifically, the controller receives input from the cable 1244, the cable feed device 1250, the first motor 1254, and/or the drum 1242. The controller 1305 processes the signal from the various components and sends an instruction to the cable feed device 1250, the first motor 1254, or both to change an operating parameter of the motor 1254, the cable feed device 1250, or both based on the signal received. In addition, the controller 1305 communicates with a data log 1310 and a notification system 1315. In other embodiments, the controller 1305 may receive inputs from other components of the drain cleaning device 1200 such as the power tracks 1226, the second motor 1286, and/or the like. Further, the controller 1305 may output commands to other components of the drain cleaning device 1200.

With continued reference to FIG. 5, the cable feed device 1250 includes one or more sensors operable to detect characteristics of the cable 1244 and performance characteristics of the drain cleaning device 1200. In the illustrated embodiment, the cable feed device 1250 includes a position sensor 1320, a speed sensor 1325 (e.g., a rotary encoder wheel), a force sensor 1330, and a cable sensor 1335 (e.g., a linear distance sensor). In other embodiments, the cable feed device 1250 may include only a subset of these sensors. In further embodiments, one or more of the sensors 1320, 1325, 1330, 1335 may be located elsewhere on the drain cleaning device 1200.

The position sensor 1320 may be positioned on or adjacent the handle 1294 to detect the position of the handle 1294. For example, the position sensor 1320 may detect whether the handle 1294 has been moved to put the cable feed device 1250 in the payout mode, the retract mode, or the neutral position. The position sensor 1320 may then communicate the position of the handle 1294 and/or the mode of the cable feed device 1250 to the controller 1305.

The speed sensor 1325 detects the speed and/or the acceleration of the cable 1244 being payed out of the drum 1242 or retracted into the drum 1242. The speed sensor 1325 then communicates the speed and/or acceleration of the cable 1244 to the controller 1305.

The force sensor 1330 determines the axial load of the cable 1244 being payed out or drawn into the drum 1242. The force sensor 1330 then communicates the axial force to the controller 1305.

The cable sensor 1335 detects characteristics of the cable 1244 such as the type and/or the size (e.g., diameter) of the cable 1244 that is being used with the drain cleaning device 1200. The type of cable may indicate a material of the cable (e.g., high grade steel versus lower grade steel, etc.). Additionally or alternatively, the type of cable may indicate a size/length of the cable, a weight of the cable, a strength rating of the cable, a bend radius of the cable, a brand of the cable, and the like. The cable sensor 1335 then communicates the type and/or size of the cable 1244 to the controller 1305.

In further embodiments, the cable feed device 1250 may include an image sensor that detects variable attenuating light from the cable 1244 as it is retracted and payed out of the drum 1242. The image sensor then communicates the amount of light to the controller 1305

The cable 1244 may additionally include a plurality of sensors to detect characteristics of the cable or performance characteristics of the drain cleaning device. For example, the cable 1244 may include an impact sensor 1340 for sensing when the cable 1244 impacts a clog or a bend in a conduit. The impact sensor 1340 then communicates the position and/or size of a clog or bend to the controller 1305. In addition, the cable 1244 may include a speed and torque sensor 1345 for detecting the speed the cable 1244 is travelling through a conduit and the torque of the cable 1244 while spinning in the conduit. The speed and torque sensor 1345 then communicates the speed and torque of the cable 1244 back to the controller 1305. Further, the cable 1244 may include a plurality of transmitters, such as, radio frequency identification (RFID) tags. The tags may be spaced in intervals along the length of the cable 1244. Each tag may include a different unique ID code that correspond to a specific position along the length of the cable 1244. The tags would be read by a sensor (e.g., a RFID tag reader) that would communicate the specific ID code to the controller 1305. The RFID tag reader may be positioned on the cable feed device 1250 or another part of the drain cleaning device 1200.

The first motor 1254 may include a plurality of sensors that are operable to detect performance characteristics of the drain cleaning device 1200. For example, the first motor 1254 may include a rotary encoder 1350 to detect the revolutions per minute (RPM) of the drum 1242, a tool coupled to the first motor 1254, and/or the cable 1244. For example, the encoder 1350 may include Hall effect sensors internal to the first motor 1254 that can sense the rotation speed of an output shaft of the first motor 1254. The encoder 1350 then communicates the RPM to the controller 1305. In addition, the first motor 1254 may include a speed and torque sensor 1355 that detects the speed and torque of the first motor 1254. The speed and torque sensor 1355 then communicates the torque and speed of the first motor 1254 to the controller 1305.

The drum 1242 may include a plurality of sensors to detect performance characteristics of the drain cleaning device. For example, the drum includes a load sensor 1360 (e.g., an accelerometer) to determine the amount of load the drum 1242 and drain cleaning device 1200 is experiencing. For example, the load sensor may detect the amount of vibration the drum 1242 and/or drain cleaning device 1200 is experiencing during operation. The load sensor 1360 then communicates the load to the controller 1305 for the controller to determine the stability of the drain cleaning device 1200. In some embodiments, the load sensor 1360 may include a safety switch positioned on the bottom of the frame 1210 to detect the separation of the drain cleaning device 1200 from a surface that the drain cleaning device is positioned on. In such a case, the load sensor 1360 may then communicate to the controller 1305 a distance of separation of the drain cleaning device 1200 from the surface. For example, if the distance between the surface and the drain cleaning device 1200 is above a predetermined threshold, the controller may shut off operation of the drain cleaning device 1200 to inhibit the drain cleaning device 1200 from tipping over.

During operation of the drain cleaning device 1200, the controller 1305 processes one or more of the inputs or performance characteristics described above to further control an operation parameter of the drain cleaning device 1200. For example, the controller 1305 may detect from one of the sensors described above a characteristic of the cable 1244 such as the type and/or size of the cable 1244. Then, based on the type and or size of the cable 1244, the drain cleaning device 1200 can automatically modulate an operating parameter of the motor 1254 based on the signal received from the sensor. For example, the controller 1305 may send an instruction to the motor 1254 to modulate the maximum spinning speed and/or torque and/or other first motor characteristics to reduce the possibility of the cable 1244 rats-nesting or being broken. Similarly, the cable sensor 1335 may detect if the cable 1244 is thicker or more robust. The controller 1305 will then automatically modulate the maximum spinning speed and/or torque and/or motor characteristics to allow for greater performance for cables that can withstand that performance.

In addition, the controller 1305 may receive an input or a signal from the force sensor 1330 or the speed sensor 1325 on the cable feed device 1250, the speed and torque sensor 1345 on the cable 1244, the encoder 1350 and/or the speed and torque sensor 1355 of the first motor 1254, and/or the load sensor 1360 on the drum 1242 that is indicative of a performance characteristic of the drain cleaning device 1200. The controller 1305, based on these inputs, may send an instruction to the cable feed device 1250, the first motor 1254, or both to change an operating parameter of the motor 1254, the cable feed device 1250 or both. For example, the controller 1305 may automatically set the RPM of the first motor 1254 and/or drum 1242 and set the cable feed speed and/or direction provided by the cable feed device 1250 to help a user successfully remove a clog without rats-nesting or breaking the cable 1244. For example, if the cable 1244 experiences a clog, the drain cleaning device 1200 will detect high torque and/or high feed force. The controller 1305 will sense the high torque and/or feed force and toggle the cable feed device 1250 between the payout mode and the retract mode to move the cable 1244 forward and backward to pass through the clog. Further, the controller 1305 may receive a signal indicative of extreme torque from either the first motor 1254 or the cable 1244, the feed force of the cable 1244, or the stability of the drain cleaning device 1200 based off the load sensor 1360 and shut down the drain cleaning device 1200 if any of those parameters exceed a predetermined threshold.

The controller 1305 may automatically alert a user of various tool conditions and/or faults. The controller 1305 may, for example, send a signal to the notification system 1315 to alert a user that the cable 1244 has encountered a clog or a bend. Additionally, the controller 1305 may send a signal to the notification system 1315 to alert a user that the drain cleaning device 1200 has been turned off for a given reason. The signals to the notification system 1315 may be based on, for example, extreme torque from either the first motor 1254 or the cable 1244, the feed force of the cable 1244, or the stability of the drain cleaning device 1200 based off the load sensor 1360). In other embodiments, the controller 1305 may alert a user to other operating parameters or characteristics of the drain cleaning device such as cable speed, cable force, cable position, and the like. The controller 1305 may also receive a signal from the RFID tag reader and communicate the most recent ID code read to the notification system 1315.

The notification system 1315 may communicate the alert to a user by an indicator. The indicator may be part of the drain cleaning device 1200 or may be part of an external device. For example, the indicator may include a display on the drain cleaning device 1200, one or more lights (e.g., LEDs) positioned on the drain cleaning device 1200, a speaker on the drain cleaning device, and the like. Alternatively, the indicator may be part of a user's personal electronic device (e.g., smartphone, laptop computer, tablet computer) with which the notification system 1315 communicates. The notification system 1315 may communicate with an external device via a wired connection or a wireless communication device 1365 (e.g., Bluetooth, WiFi, cellular, etc.). Additionally, a user may control settings on the drain cleaning device 1200 through the notification system 1315 (e.g., via a display) or add additional inputs for the controller 1305 to monitor, such as, pipe size, type of clog, and controller sensitivity. The controller 1305 may then control the drain cleaning device 1200 based on these inputs.

Further, the controller 1305 may store any of the operating parameters, performance characteristics, conditions, or faults in the data log 1310. The data log 1310 may be a data file stored in a memory connected to or part of the controller 1305. The data log 1310 may be accessed by a user through a display on the drain cleaning device 1200. The data log 1310 may also or alternatively be transmitted to a remote device, computer, or server through a wired or wireless connection. For example, the controller 1305 may store the position of a clog or a bend that the cable 1244 encounters within a conduit. In other embodiments, the controller 1305 may store the distance a drain has been cleaned or if the cable 1244 has been jammed.

In some embodiments, the controller 1305 ensures that when one motor is operating, the other motor is locked out and cannot be run. Additionally, the power supply 1222 may include switches, buttons, a user interface, or other control features that allow a user to selectively control the drain cleaning device 1200 based on the parameters and conditions detected by the controller 1305. Further, the power supply 1222 or the battery may include a battery fuel gauge to indicate to a user how much longer the battery will last. In addition, the drain cleaning device 1200 may include battery detection that indicates to a user if the drain cleaning device 1200 has enough power to climb a standard set of stairs and, if not, lock out the tracks 1226 from being operated.

Supplying the drain cleaning device 1200 with the control system 1300 as described above advantageously allows an inexperienced user to successfully operate the drain cleaning device 1200 without damaging the cable 1244 and/or the motors 1254, 1286. The controller 1305 automatically modulates the motor torque/RPM and the cable speed and cable force to reduce the possibility of the cable 1244 from rats-nesting or breaking. For example, when encountering a clog, rather than allowing a user to operate the drain cleaning device 1200 beyond the capability of the motors 1254, 1286 and/or the cable 1244, the controller 1305 detects high torque and/or high feed force by the sensors. The controller 1305 then automatically actuates the cable feed device 1250 in a proper manner (e.g., forward and backward at suitable speeds) to pass through the clog. In addition, when the cable 1244 becomes jammed, the controller 1305 detects extreme torque, feed force, and/or loss of stability and shuts down the drain cleaning device 1200. The controller 1305 can also notify a user of the clog and or jam through the notification system 1315 so that the user understands why the drain cleaning device 1200 is performing in a certain manner.

Figure 6:
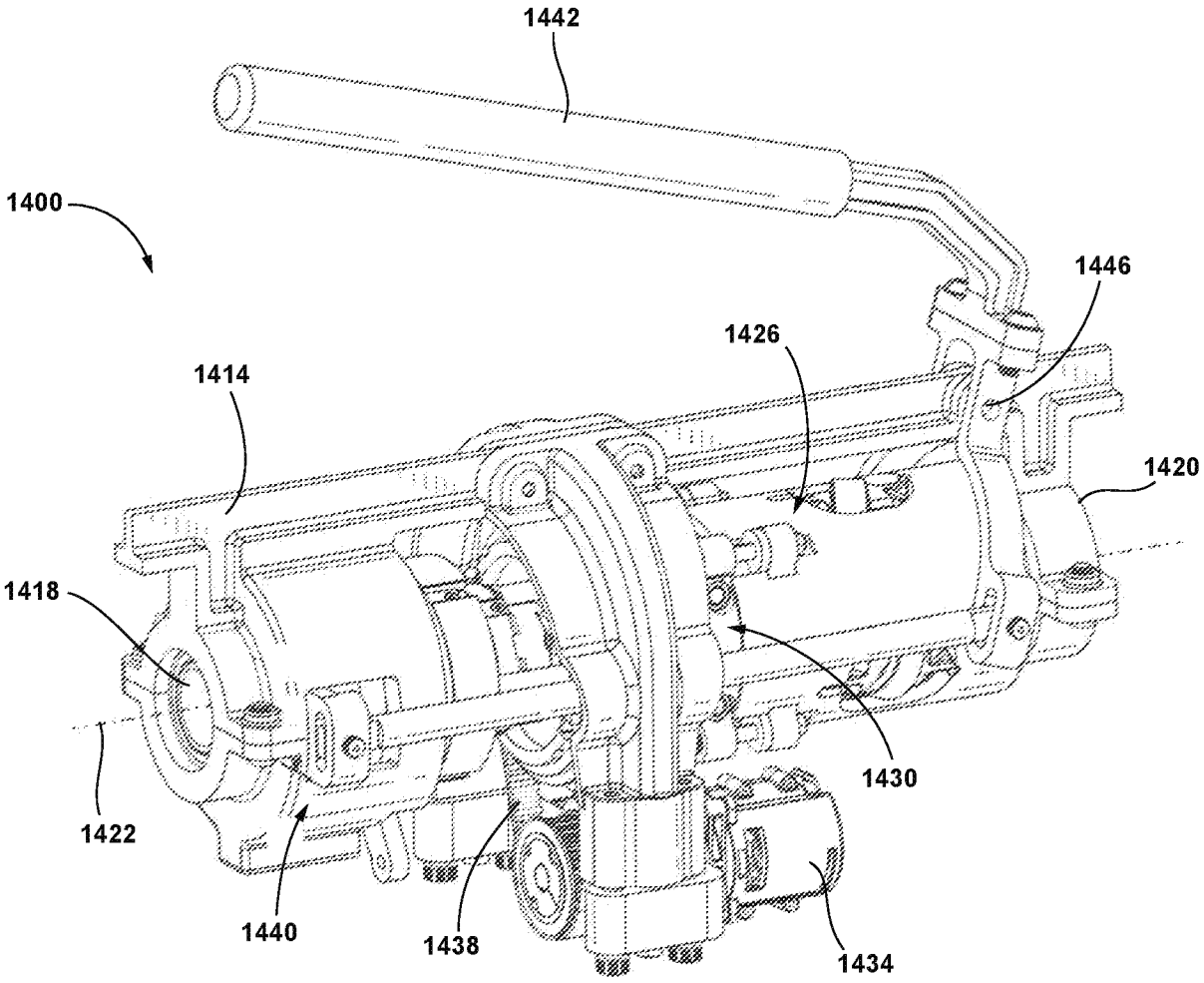
FIG. 6 is a perspective view of a drain cleaning device according to another embodiment of the invention.
Figure 7:
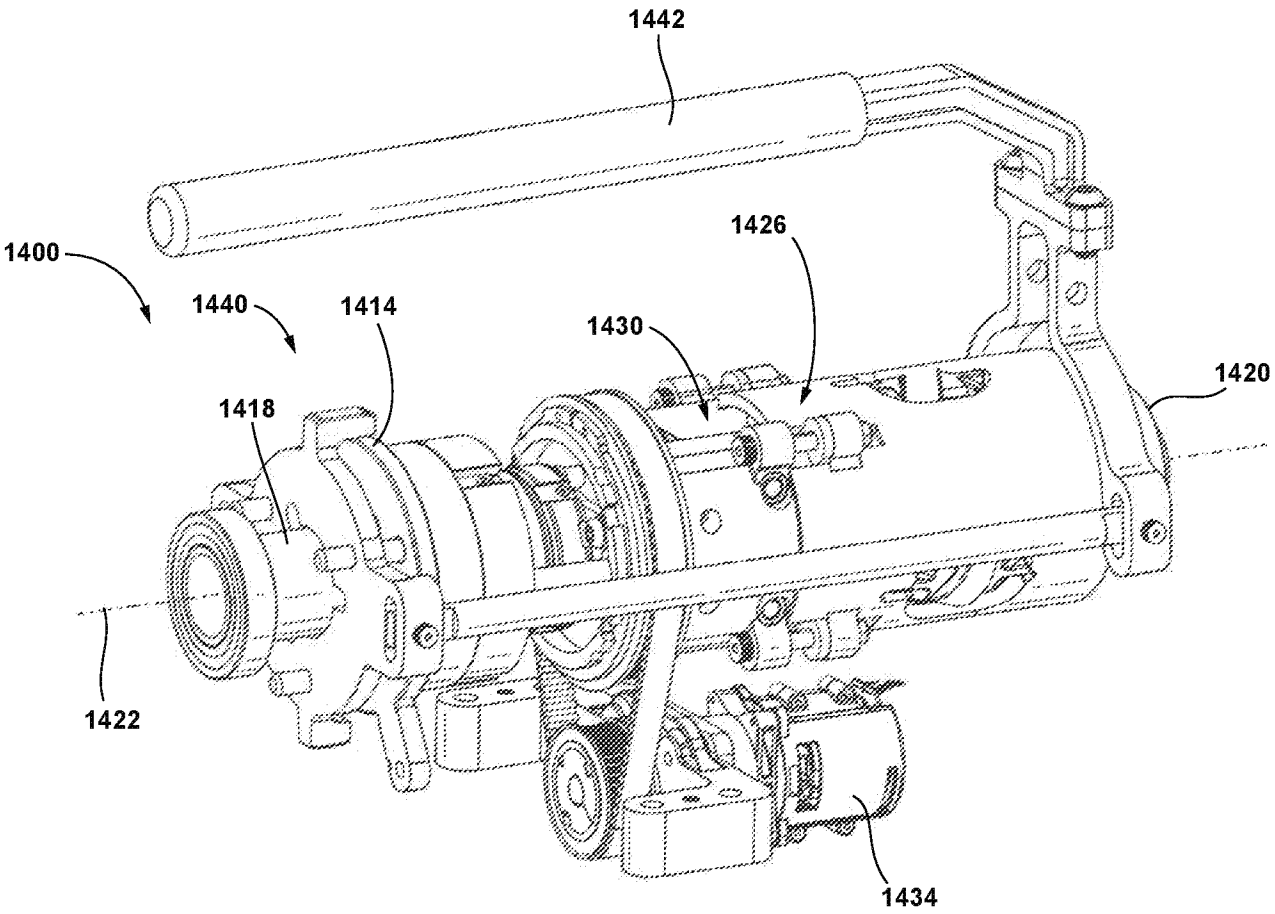
FIG. 7 is a perspective view of the drain cleaning device of FIG. 6, with portions removed.

FIGS. 6 and 7 illustrate a drain cleaning device 1400 according to another embodiment of the invention. The drain cleaning device 1400 is operable with the control system 1300 as described above. The drain cleaning device 1400 includes a frame 1414, a cable outlet tube 1418 and cable inlet tube 1420 collectively defining a cable axis 1422, a cable feed mechanism 1426, a radial drive mechanism 1430, and a motor 1434 to rotate the cable feed and radial drive mechanisms 1426, 1430 about the cable axis 1422. In the illustrated embodiment, the motor 1434 is operatively coupled to and rotates the cable feed and radial drive mechanisms 1426, 1430 via a belt 1438. In some embodiments, the drain cleaning device 1400 is a DC battery powered drain cleaning device in which the motor 1434 is powered by a battery or battery pack. The battery pack may be received in a battery compartment. In some embodiment, the battery compartment may have a battery door that seals and isolates the battery from the contaminated environment, thereby keeping the battery clean and dry. In some embodiments, in addition to being powered by the battery, the drain cleaning device 1400 can also be powered by AC power. In alternative embodiments, the drain cleaning device can only be powered by AC power. The cable feed mechanism 1426 is used to move a snake (e.g., a cable or spring) (not shown) along the cable axis 1422 into or out of a drain. The radial drive mechanism 1430 is used to spin the snake about the cable axis 1422.

An actuating lever 1442 pivots on the frame 1414 about a pivot point 1446 between an activated position shown in FIG. 2 and a non-activated position shown in FIG. 1. In some embodiments, the actuating lever 1442 activates the motor 1434 when set to the activated position. In alternative embodiments, instead of actuating lever 1442, a separate switch or actuator, such as a foot pedal, can be used to activate the motor 1434. A selection mechanism 1440 may allow an operator to switch between selecting the cable feed mechanism 1426 or the radial drive mechanism 1430 in manipulating the snake.

The control system 1300 may control operation of the drain cleaning device 1400. For example, the controller 1305 may receive input from the cable feed and radial drive mechanisms 1426, 1430, the selection mechanism 1440, the actuating lever 1442, and/or the motor 1434. The controller 1305 may then assist a user in operating the drain cleaning device 1400 and the snake to clear a clog without damaging or rats-nesting the snake, as described above. Specifically, the controller 1305 may control the selection mechanism 1440 to alternate between driving the cable feed mechanism 1426 or the radial drive mechanism 1430

Figure 8:
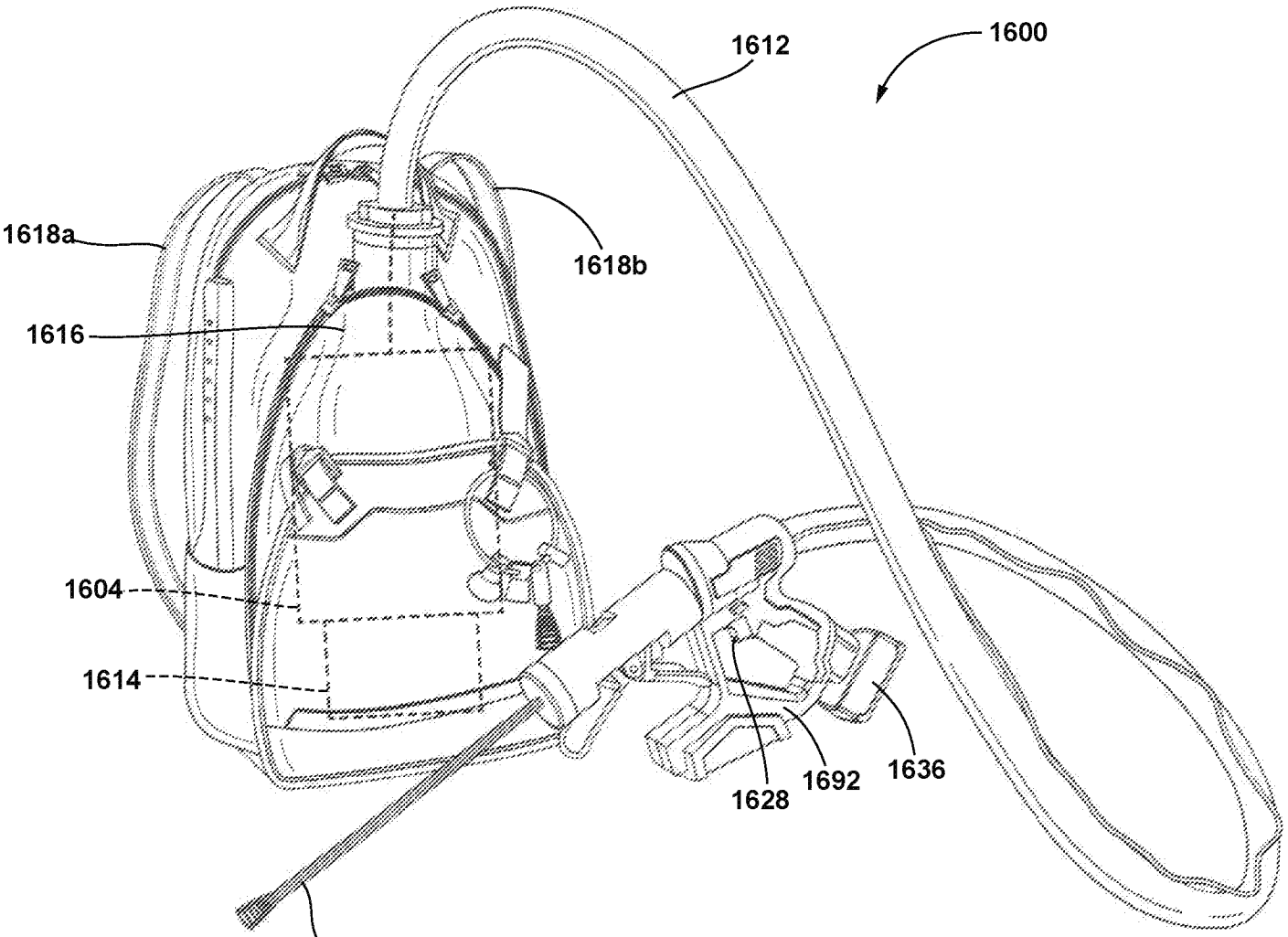
FIG. 8 is a perspective view of a drain cleaning device according to another embodiment.

FIG. 8 illustrate a drain cleaning device 1600 according to another embodiment of the invention. The drain cleaning device 1600 is operable with the control system 1300 described above. The drain cleaning device 1600 includes a drum 1604 housed inside a carrier 1616, a cable 1608, a cable shroud 1612, and a feed control mechanism 1692. The drain cleaning device 1600 also includes a motor 1614 and a drive mechanism (not shown) for rotating the drum 1604. The drum 1604 and the motor 1614 are configured to rotate within the carrier 1616. In the illustrated embodiment, the carrier 1616 is a bag, such as a soft-sided bag that can be carried by a user. More particularly, the illustrated carrier 1616 is a backpack having straps 1618*a*, 1618*b*, but could be another bag type such as an over-the-shoulder bag. The cable 1608 is partially housed within the drum 1604 and partially housed within the cable shroud 1612. The cable shroud 1612 extends between the drum 1604 and the feed control mechanism 1692. The cable shroud 1612 and the feed control mechanism 1692 work together to direct the cable 1608 into the drain. In use, the cable 1608 extends from the drum 1604, through the cable shroud 1612 to the feed control mechanism 1692, and into the drain. A battery 1636 is selectively attached to the feed control mechanism to power the drain cleaning device 1600. The feed control mechanism 1692 is coupled to the motor 1614 to control operation of the motor 1614 and to feed the cable 1608 into and out of the drum 1604.

The feed control mechanism 1692 can be used to selectively feed the cable 1608 into or out of the drain. The feed control mechanism 1692 may be used to control the speed and direction in which the cable 1608 is fed into the drain. The feed control mechanism 1692 also includes a speed control switch 1628. In some embodiments, the feed control switch 1628 is a trigger that is actuatable (e.g., depressible) by a user to selectively energize the motor 1614 and, thereby, operate the drain cleaning device 1600. In particular, the speed control switch 1628 is electrically coupled to the drum 1604 to selectively rotate the drum 1604. The speed control switch 1628 controls the speed that the drum 1604 and the cable 1608 rotate, which in turn, controls the speed at which the cable 1608 is fed in the axial direction. Thus, the speed control switch 1628 can be used to control the speed that the cable 1608 is fed into or out of the drain.

The control system 1300 may control operation of the drain cleaning device 1600. For example, the controller 1305 may receive input from the motor 1614, the drum 1604, the feed control mechanism 1692, and/or the cable 1608. The controller 1305 may then assist a user in operating the drain cleaning device 1600 and the cable 1608 to clear a clog without damaging or rats-nesting the cable 1608, as described above. In particular, the controller 1305 may control the speed and direction of the cable 1608 and or the rotation of the drum 1604 through the feed control mechanism based on input received from the motor 1614 and/or the cable 1608.

Figure 9:
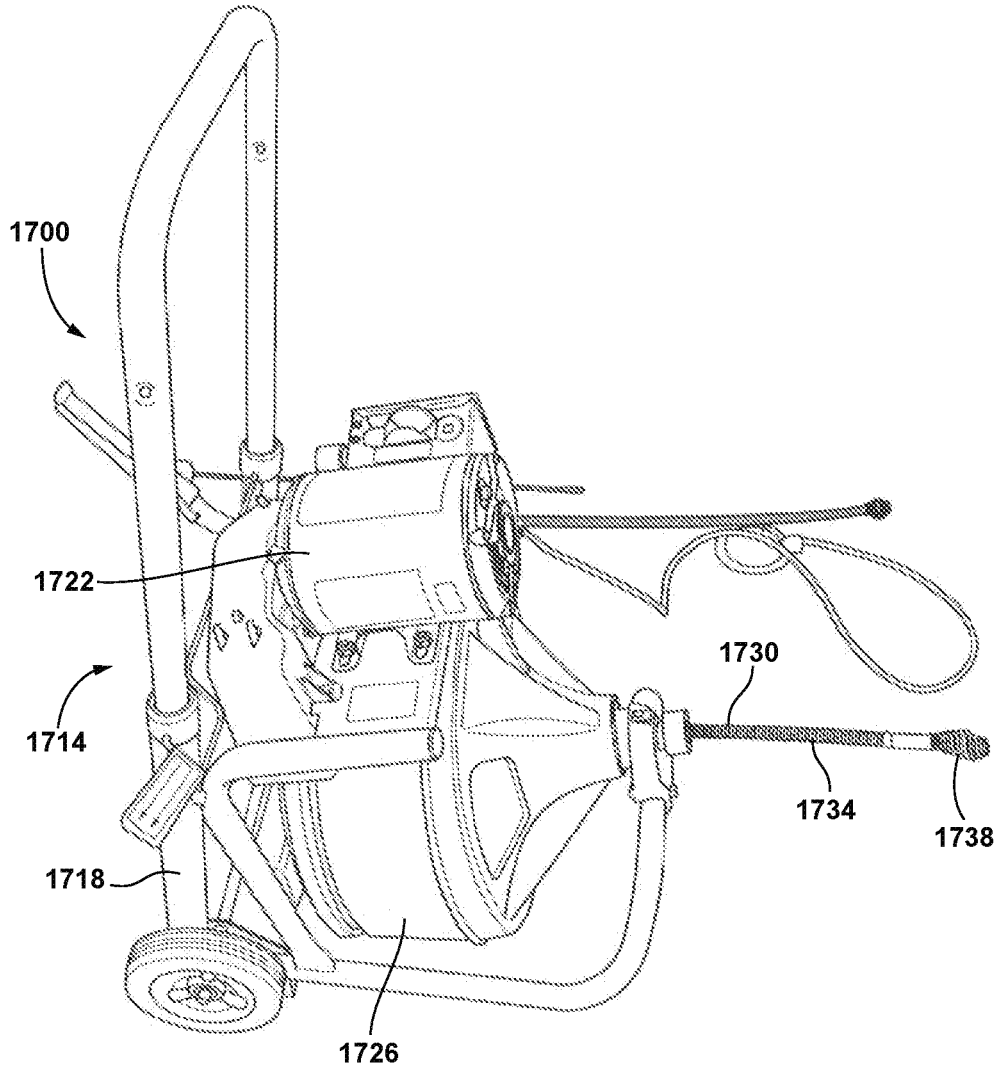
FIG. 9 is a perspective view of yet another drain cleaning device.
Figure 10:
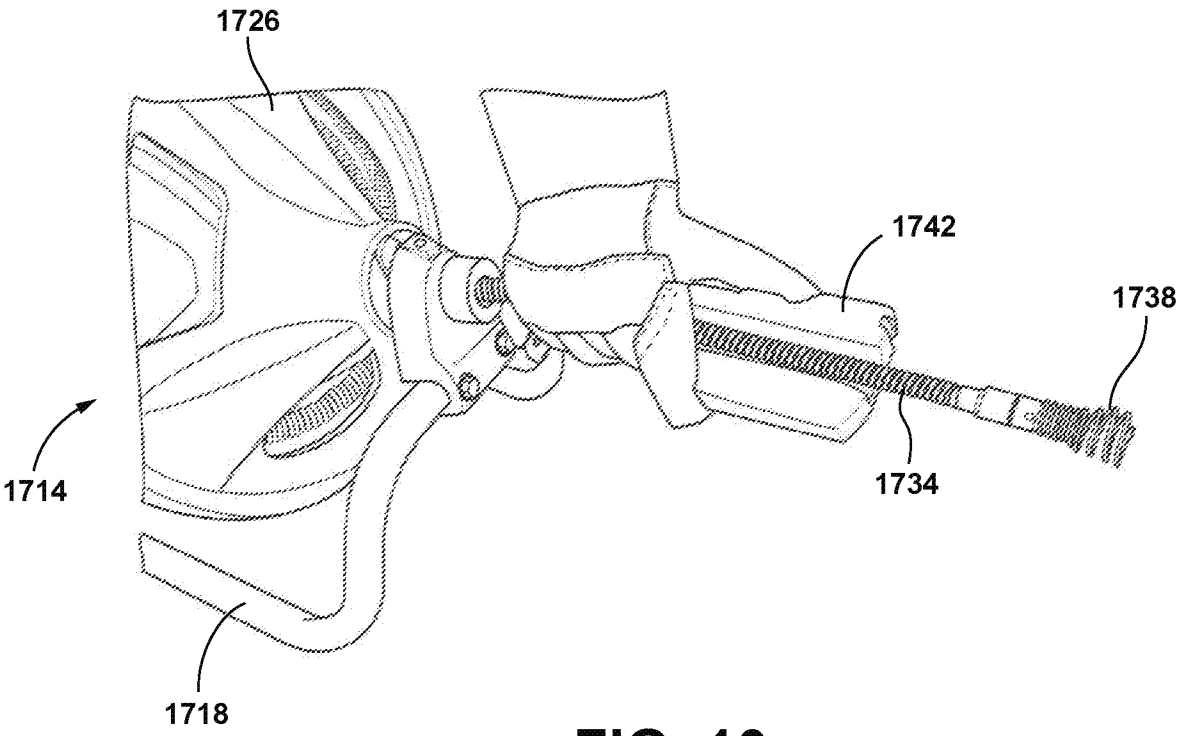
FIG. 10 is a perspective view of a handle of the drain cleaning device of FIG. 9.

FIG. 9 illustrates a drain cleaning device 1700 according to another embodiment. The illustrated drain cleaning device 1700 is a free standing drain cleaning device 1700 and is operable with the control system 1300 described above. The drain cleaning device 1700 includes a base unit 1714 having a frame 1718, a motor 1722, a drum 1726, and a cable 1730. The motor 1722 and the drum 1726 are supported by the frame 1718. The cable 1730 is at least partially housed in the drum 1726, with a leading end 1734 of the cable 1730 extending outside of the drum 1726. The drum 1726 is rotatably supported by the frame 1718 such that the drum 1726 can rotate relative to the frame 1718. In the illustrated embodiment, rotation of the drum 1726 is driven by the motor 1722, and rotation of the drum 1726 causes the cable 1730 to rotate. In addition to rotating, the cable 1730 can also be displaced in an axial direction so that the cable 1730 can be fed into the drain. Specifically, the leading end 1734 of the cable 1730 is fed into a drain to unclog the drain and remove debris. In the illustrated embodiment, the leading end 1734 is manually guided into a drain by a user pulling the cable 1730 out of the drum 1726 and feeding the cable 1730 into the drain. The leading end 1734 of the cable 1730 may include an auger head 1738 or other tool attachment to help unclog the drain. As shown in FIG. 10, the illustrated drain cleaning device 1700 is provided with a handle 1742 disposed on the cable 1730. In some embodiments, the handle 1742 assists in rotating the cable 1730 as well as guiding the cable 1730 into the drain.

Figure 11:
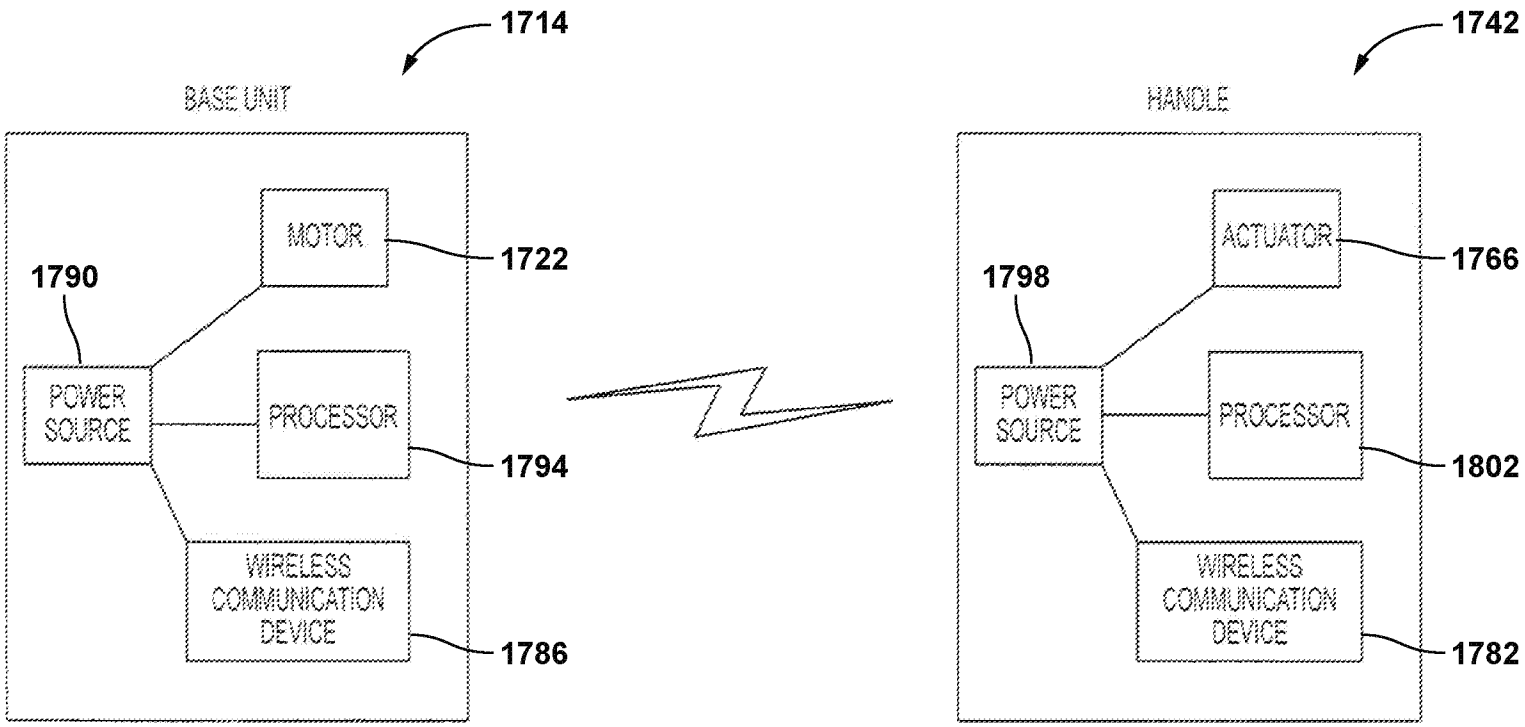
FIG. 11 is a schematic diagram of a base unit of the drain cleaning device of FIG. 9 and the handle of FIG. 10.

With reference to FIG. 11, a first power source 1790 is supported on the base unit 1714. The first power source 1790 is electrically coupled to the motor 1722, a first processor 1794, and a first wireless communication device 1786. The first power source 1790 may be a battery pack, such as a rechargeable power tool battery pack. Alternatively, the first power source 1790 may include circuitry for receiving power from an external AC power source.

The handle 1742 includes a second power source 1798 supported by the body 1744 to provide power to a second wireless communication device 1782, a second processor 1802, and an actuator 1766. The second power source 1798 may be, for example, one or more batteries. In the illustrated embodiment, the handle 1742 may include a battery receptacle for receiving the batteries to power the handle 1742. In some embodiments, the handle 1742 may be hardwired to the base unit 1714 to communicate with the motor 1722 and/or for receiving AC power.

In operation, when a user presses the actuator 1766 on the handle 1742, the first wireless communication device 1782 sends a signal to the second communication device 1786. The signal is interpreted by the first processor 1794, and the first processor 1794 instructs the motor 1722 to actuate.

The control system 1300 may control operation of the drain cleaning device 1700. For example, the controller 1305 may receive input from the motor 1722, the drum 1726, the handle 1742, and/or the cable 1608. The controller 1305 may then assist a user in operating the drain cleaning device 1700 and the cable 1608 to clear a clog without damaging or rats-nesting the cable 1608, as described above. In particular, the controller 1305 may communicate with the handle 1742 via the wireless communication devices 1782, 1786, 1365 to control the drain cleaning device. Further, the notification system 1315 of the control system 1300 may send an alert to the handle 1742.

Figure 13:
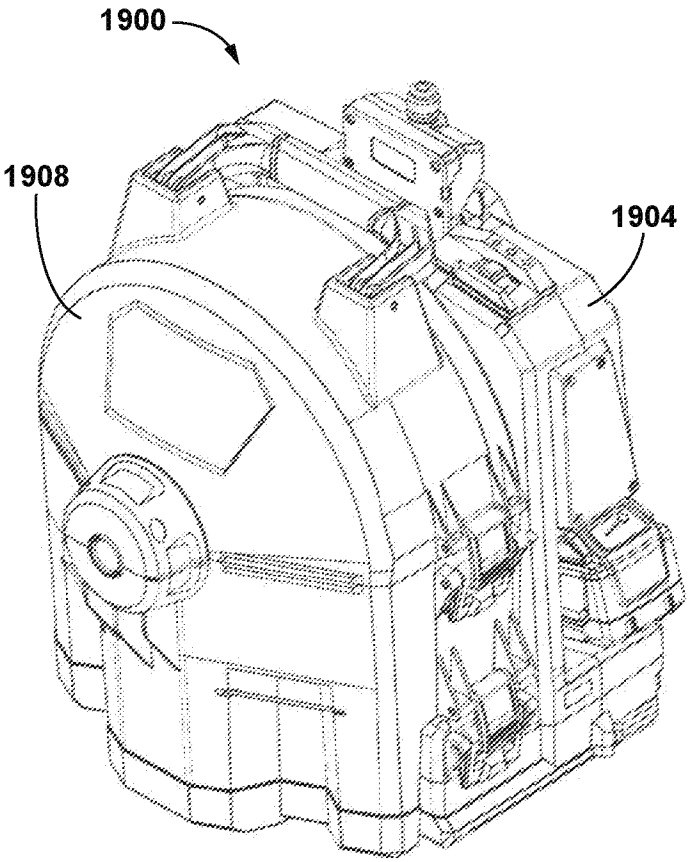
FIG. 13 is another perspective view of the drain cleaning device of FIG. 12.
Figure 12:
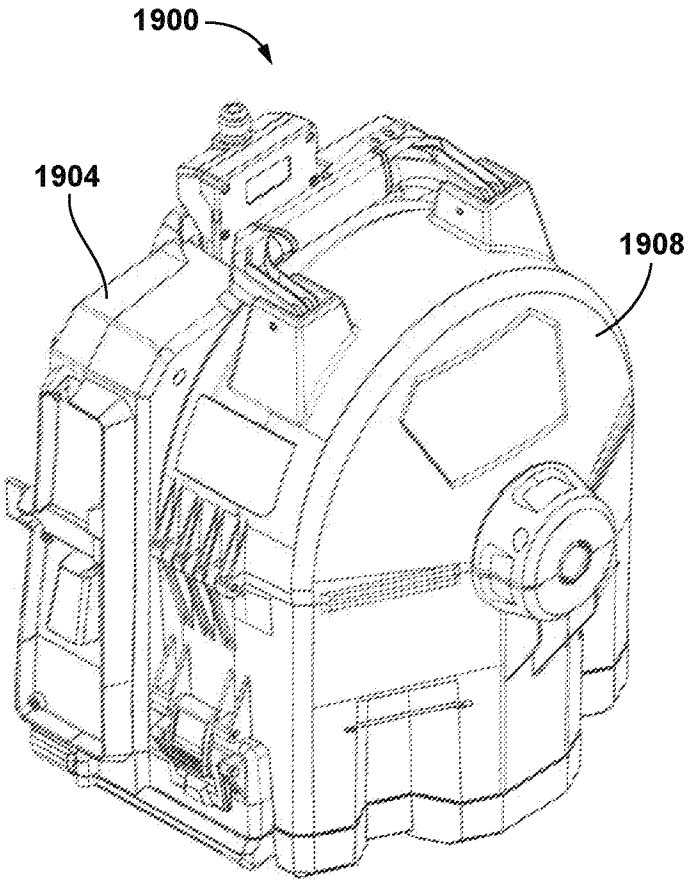
FIG. 12 is a perspective view of a drain cleaning device according to another embodiment of the invention.

FIGS. 12 and 13 illustrate a drain cleaning device 1900 according to another embodiment of the invention. The drain cleaning device 1900 is operable with the control system 1300 as described above. The drain cleaning device 1900 includes a first unit 1904 and a second unit 1908. The first unit 1904 is a base unit or drive unit. The second unit 1908 is a drum unit. The drain cleaning device 1900 is modular such that the second unit 1908 is removable from the first unit 1904. The first unit 1904 includes a motor, a battery pack 1964, and a stand portion or stabilizer. Although not shown in these figures, the first unit 1904 can also include backpack-style straps. The second unit 1908 is removable from the first unit 1904 and includes a contained cable drum. In one embodiment, the drum can be dropped into place to interface with the motor and be rotated by the motor, e.g., moved solely in the vertical direction relative to the first unit 1904 to interface the second unit 1908 with the first unit 1904 such that the drum can be rotated by the first unit 1904. The drum can also be carried separately from the motor, the battery 1964, and the stand portion to provide easier, more manageable carrying of the heavy drain cleaning device 1900 by a user. For example, the user can distribute the weight of the drain cleaning device 1900 between the drum carried in the user's hands and the first unit 1904 carried on the user's back using the backpack straps. Additionally, various different drums, e.g., containing different sizes, lengths, types, etc. of cables can be attached to the same first unit. Thus, the first unit 1904 can be used to drive various different drums containing various different cables. The drum contains a cable. When a user reaches an end of the cable (e.g., all of the cable has been fed out of the drum), often times the user will swap in a new drum with more cable, attach an end of the new cable to the end of the old cable, and continue feeding cable down a drain.

The control system 1300 may control operation of the drain cleaning device 1900. For example, the controller 1305 may receive input from the first unit 1904 or the second unit 1908 on the motor or the drum. The controller 1305 may then assist a user in operating the drain cleaning device 1900 and the cable to clear a clog without damaging or rats-nesting the cable, as described above. In addition, the controller 1305 may communicate to the user when the cable of one drum has reached an end indicating to a user a new cable and/or drum is needed to continue.

Figure 14:
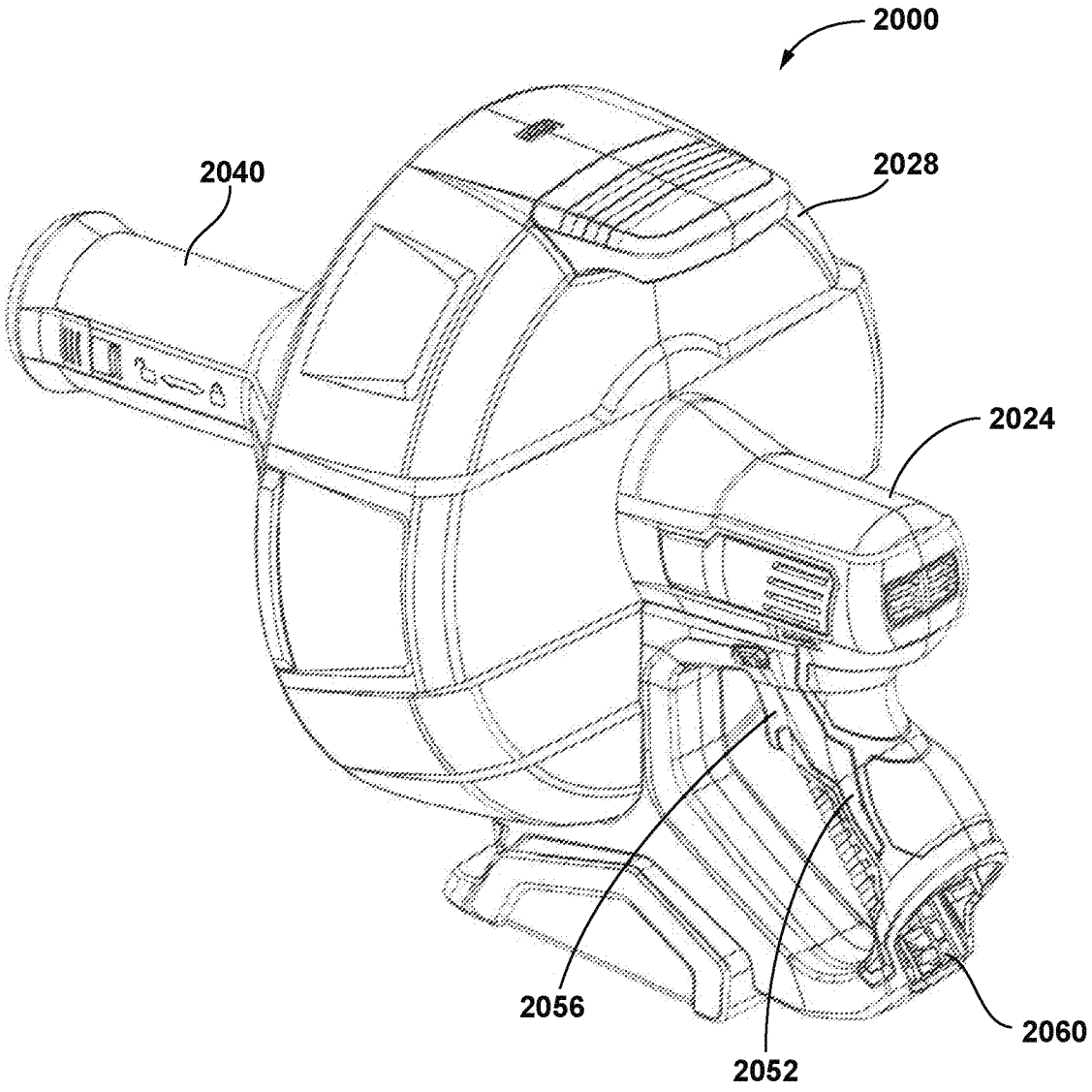
FIG. 14 is a rear perspective view of a drain cleaning device according to another embodiment.
Figure 15:
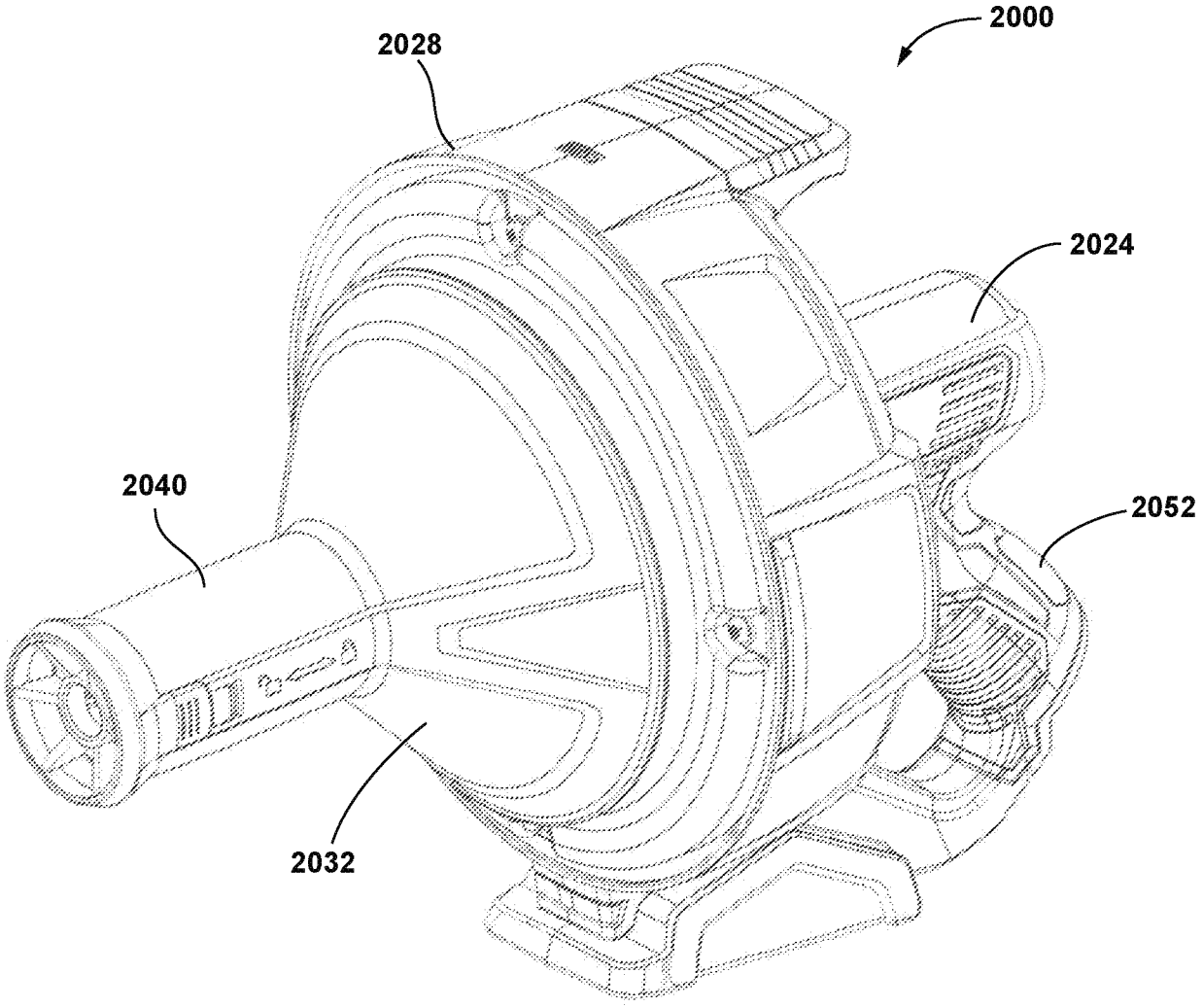
FIG. 15 is a front perspective of the drain cleaning device of FIG. 14.
Figure 16:
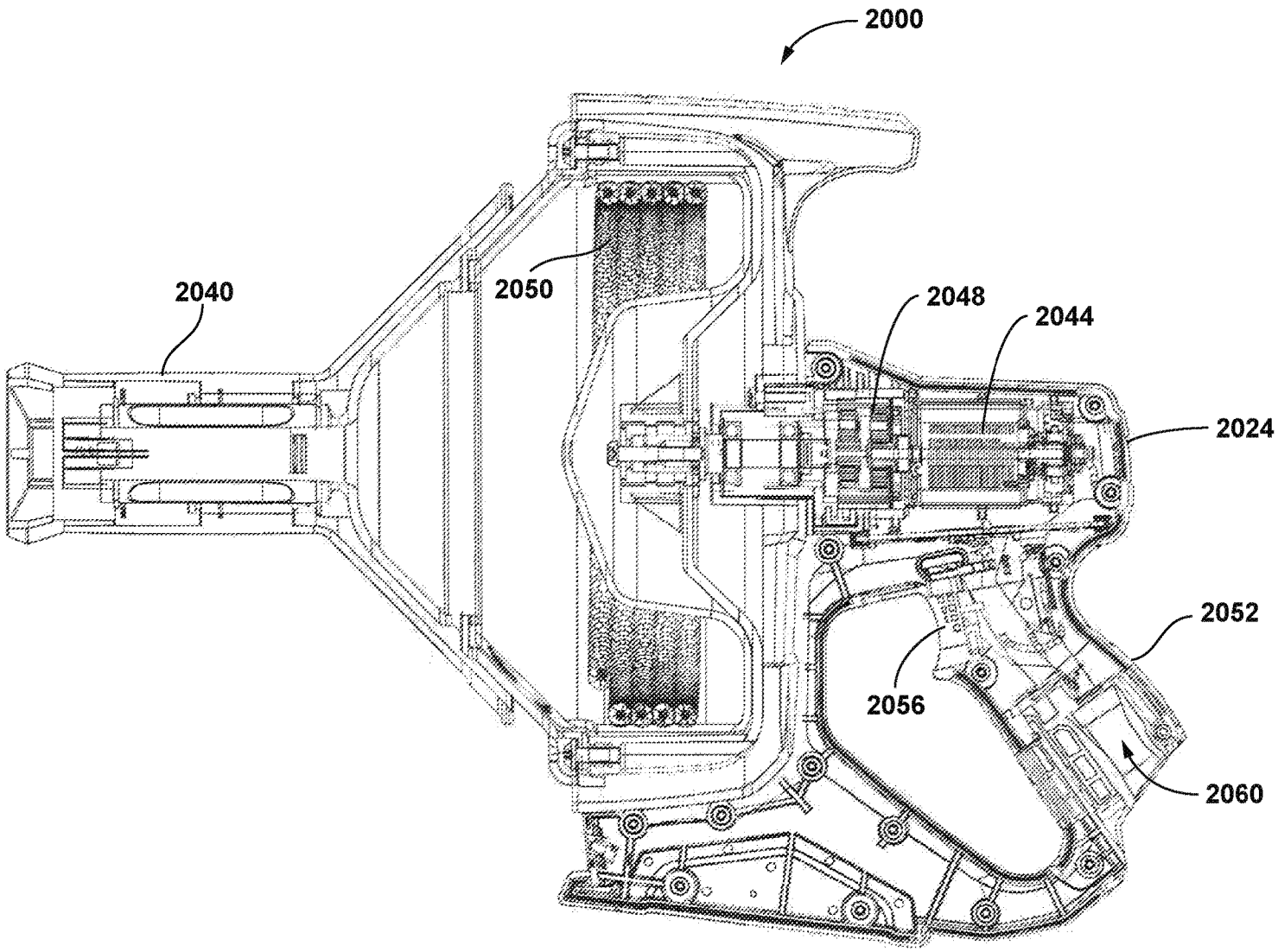
FIG. 16 is a cross sectional view of the drain cleaning device taken along section line 4A-4A of FIG. 14.

FIGS. 14 and 15 illustrate a drain cleaning device 2000 according to another embodiment of the invention. The drain cleaning device 2000 is operable with the control system 1300 described above. The illustrated drain cleaning device 2000 includes a handle assembly 2024, a shroud 2028, a drum assembly 2032, and a nose assembly 2040. In one embodiment, the shroud 2028 may be a drum shield. As shown in FIG. 16, the drain cleaning device 2000 also includes a motor 2044 and a drive mechanism 2048 positioned within the handle assembly 2024. The drain cleaning device 2000 further includes a flexible cable 2050 that is stored within the drum assembly 2032 and extends out of the nose assembly 2040. The cable 2050 is insertable into a drain, or other conduit, for cleaning the drain. In some embodiments, the cable 2050 may include an auger head or other tool attachment at its distal end.

The handle assembly 2024 includes a grip 2052 that is configured to be grasped by a user for carrying and operating the drain cleaning device 2000. The handle assembly 2024 supports an actuator 2056 (e.g., a trigger) adjacent the grip 2052. The actuator 2056 is actuatable (e.g., depressible) by a user to selectively energize the motor 2044 and, thereby, operate the drain cleaning device 2000. The illustrated handle assembly 2024 also includes a battery receptacle 2060 for receiving and supporting a battery pack, such as a power tool battery pack. The battery receptacle 2060 includes terminals that electrically connect the battery pack to the motor 2044 and the actuator 2056. In other embodiments, the handle assembly 2024 may support a power cord to electrically connect the motor 2044 to an AC power source.

Friction between the inner surface of the drum 2032 and the cable 2050 causes the cable 2050 to rotate or spin with the drum assembly 2032. As the drum assembly 2032 rotates, the cable 2050 also rotates, causing the cable 2050 to be extended into the drain or retracted from the drain. The illustrated drive mechanism 2048 includes a gear train having, for example, planetary gear arrangements and an output shaft that transmit rotation of the motor 2044 to the drum 2032. In the illustrated embodiment, the drum 2032 is threadably coupled to the output shaft of the drive mechanism 2048.

The control system 1300 may control operation of the drain cleaning device 2000. For example, the controller 1305 may receive input from the drum 2032, the drive mechanism 2048, the motor 2044, and/or the cable 2050. The controller 1305 may then assist a user in operating the drain cleaning device 2000 and the cable to clear a clog without damaging or rats-nesting the cable, as described above.

Figure 17:
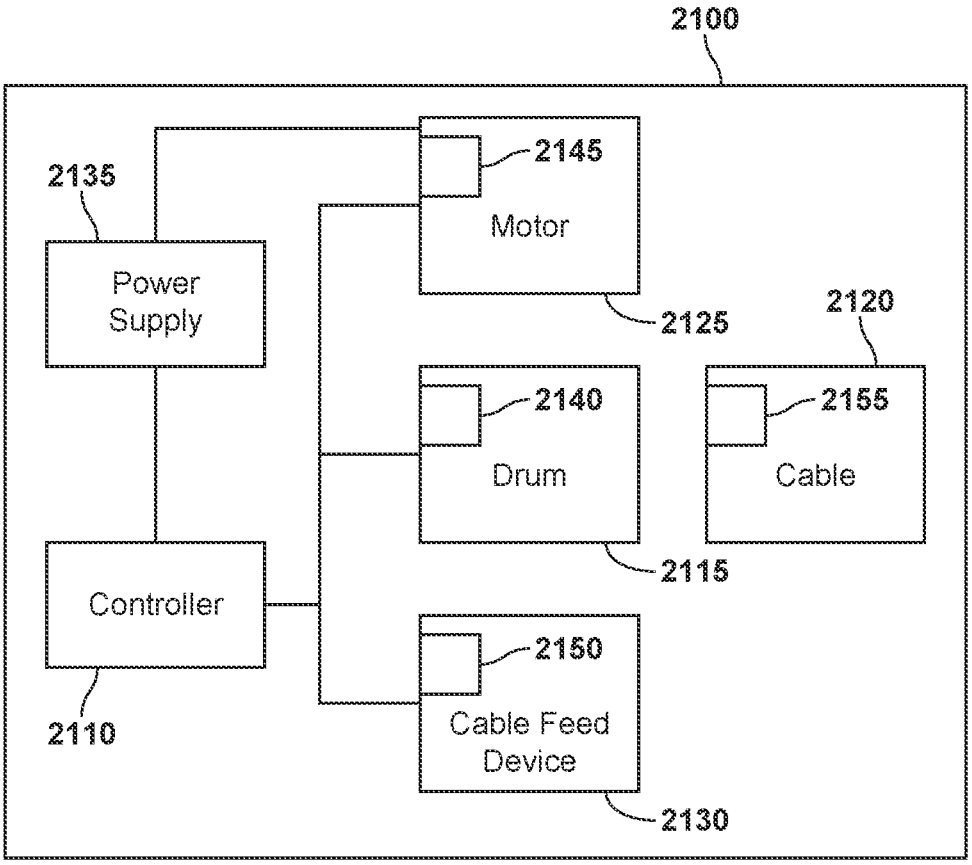
FIG. 17 is a schematic view of a drain cleaning device.

FIG. 17 schematically illustrates a drain cleaning device 2100 according to another embodiment of the invention. The drain cleaning device 2100 may be any one of the drain cleaning devices 1200, 1400, 1600, 1700, 1900, 2000 described above. The drain cleaning device 2100 is operable with the control system 1300 as described above and includes a controller 2110. The drain cleaning device 2100 further includes a drum 2115, a cable 2120 positioned within the drum 2115, a motor 2125 coupled to the drum 2115 to rotate the drum 2115, a cable feed device 2130 that is operable to extend the cable 2120 out of and retract the cable 2120 into the drum 2115, and a power supply 2135 operable to power the motor 2125 and the controller 2110. The power supply 2135 may be dedicated power supply (e.g., an on-board battery or a power tool battery pack) or may be from an external, AC power source (e.g., a wall outlet or generator). The motor 2125 receives power from the power supply 2135 to rotate the drum 2115. As the drum 2115 rotates, friction between an inner surface of the drum 2115 and the cable 2120 causes the cable 2120 to rotate or spin with the drum 2115. As the drum 2115 rotates, the cable 2120 also rotates, allowing the cable 2120 to be extended into a conduit or retracted from the conduit by the cable feed device 2130.

The drum 2115, the motor 2125, the cable feed device 2130, and the cable 2120 each include a sensor 2140, 2145, 2150, 2155 respectively. The sensors 2140, 2145, 2150, 2155 are all coupled to and in communication with the controller 2110. Each sensor 2140, 2145, 2150, 2155 is operable to detect a characteristic of the cable 2120 and/or a performance characteristic of the drain cleaning device 2100 during operation of the drain cleaning device 2100. For example, the sensors 2140, 2145, 2150, 2155 may detect the size or type of the cable 2120, the revolutions per minute of the cable 2120, the motor torque, the feed speed of the cable 2120 by the cable feed device 2130, a feed direction of the cable 2120 by the cable feed device 2130, and/or the stability of the drain cleaning device 2100. The sensors 2140, 2145, 2150, 2155 are configured to send a signal indicative of the characteristic of the cable 2120 and/or of the performance characteristic to the controller 2110.

The controller 2110 is coupled to and in communication with the motor 2125, the power supply 2135, the drum 2115, the cable 2120, and the cable feed device 2130. The controller 2110 receives signals from the sensors 2140, 2145, 2150, 2155 and sends instructions to the motor 2125, the cable feed device 2130, or both to change an operating parameter of the motor 2125, the cable feed device 2130, or both based on the signal received from the sensors 2140, 2145, 2150, 2155. For example, the controller 2110 may change, the maximum operating speed of the motor 2125, the maximum torque of the motor 2125, the revolutions per minute of the motor 2125, the feed speed of the cable 2120 by the cable feed device 2130, and/or the feed direction of the cable 2120 by the cable feed device 2130.

Figure 18:
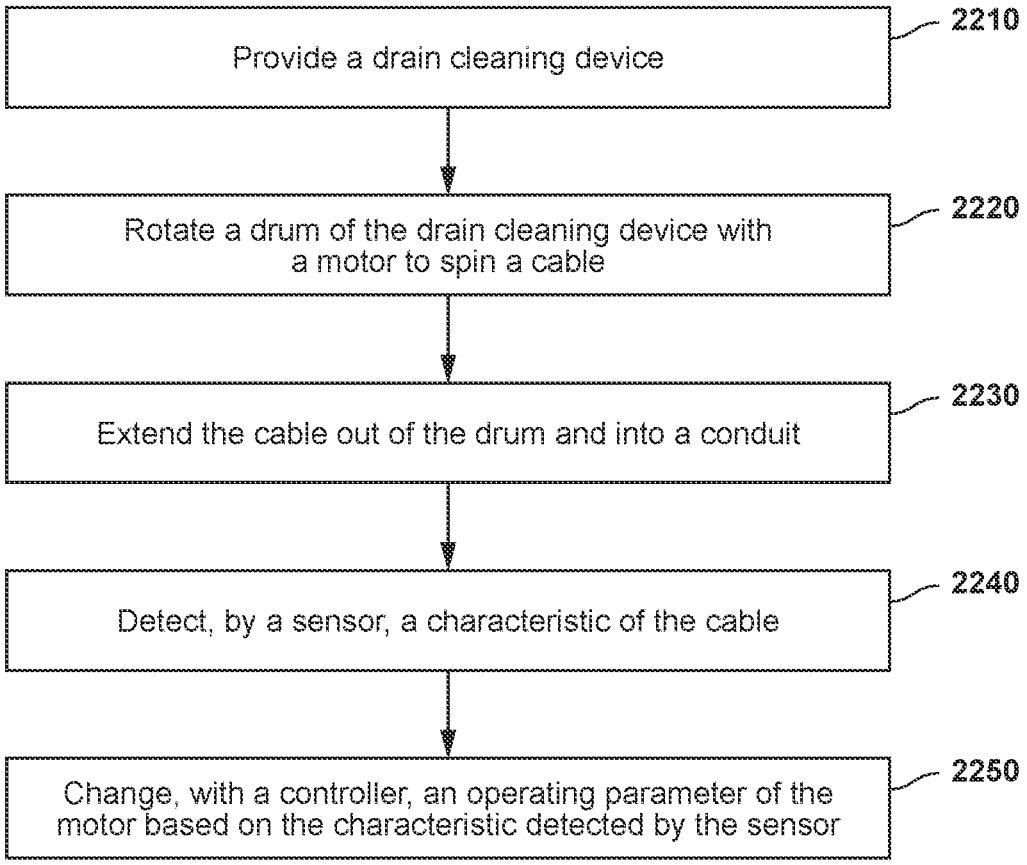
FIG. 18 is a flowchart illustrating a method of operating the drain cleaning device of FIG. 17.

FIG. 18 illustrates a method of operating the drain cleaning device 2100. The method generally relates to detecting a characteristic (e.g., type, size, etc.) of a cable and changing an operating parameter (e.g., maximum operating speed, maximum torque, etc.) of the drain cleaning device 2100 based on the detected characteristic. Although the method includes certain steps, not all of the steps need be performed or need be performed in the order illustrated. The method may also include additional or alternative steps.

The illustrated method includes providing the drain cleaning device 2100 at step 2210. Providing the drain cleaning device 2100 may include providing any of the drain cleaning devices 1200, 1400, 1600, 1700, 1900, 2000 described above. The drain cleaning device 2100 may include, for example, the drum 2115, the cable 2120, the motor 2125, one or more sensors, and the controller 2110. The drain cleaning device 2100 may also include the power supply 2135, the cable feed device 2150, and other suitable components. In some embodiments, such as for the drain cleaning device 1400 shown in FIGS. 6 and 7, the drum 2140 or other components may be omitted.

At step 2220, the drum 2115 of the drain cleaning device 2100 is rotated by the motor 2125 to spin the cable 2120. Spinning the cable 2120 helps the cable 2120 (or a tool coupled to an end of the cable 2120) cut through clogs and other debris in a conduit. Spinning the cable 2120 also helps the cable fee device 2130 feed the cable 2120 into or out of the drum 2115.

At step 2230, the cable 2120 is extended out of the drum 2115 and into a conduit. The cable 2120 may be manually extended out of the drum 2115 by a user pulling the cable 2120. Alternatively, the cable 2120 may be automatically fed out of the drum 2115 by the cable feed device 2130. Similarly, the cable 2120 may also be fed back into the drum 2115 as the cable 2120 is removed from the conduit.

At step 2240 a characteristic of the cable 2120 is detected. The characteristic may be detected by one or more of the sensors 2140, 2145, 2150, 2155. As noted above, the characteristic may be a type of cable, a size (e.g., diameter) of the cable, or both.

At step 2250 an operating parameter of the motor 2125 is changed by the controller 2110 based on the characteristic detected by the sensors 2140, 2145, 2150, 2155. For example, the controller 2110 may receive one or more signals from the sensors 2140, 2145, 2150, 2155 indicative of the detected characteristic. The controller 2110 may then send an instruction to the motor 2125 to change the operating parameter. As noted above, the operating parameter may be a maximum operating speed of the motor, a maximum torque of the motor, or both. The controller 2110 may also notify a user of the detected characteristic and/or the operating parameter through an indicator on the drain cleaning device 2100 or an external device.

Figure 19:
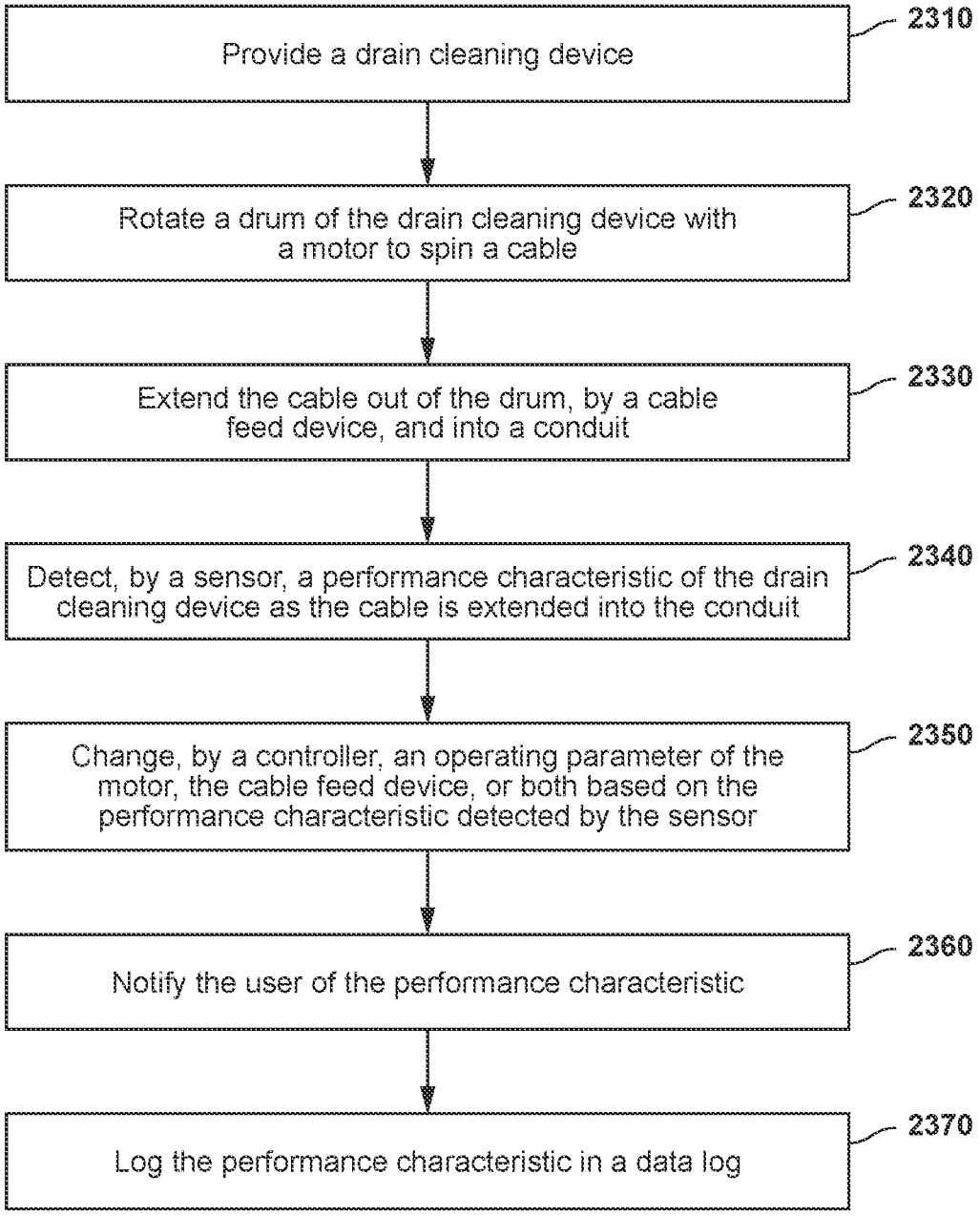
FIG. 19 is a flowchart illustrating another method of operating the drain cleaning device of FIG. 17.

FIG. 19 illustrates another method of operating the drain cleaning device 2100. The method generally relates to detecting a performance characteristic (e.g., RPMs, motor torque, feed speed, feed direction, feed force, stability, etc.) of the drain cleaning device 2100 and changing an operating parameter (e.g., RPMs, feed speed, feed direction, etc.) of the drain cleaning device 2100 based on the detected performance characteristic. Such changes may be useful when the cable 2120 encounters a clog or bend or when the cable 2120 becomes jammed. Although the method includes certain steps, not all of the steps need be performed or need be performed in the order illustrated. The method may also include additional or alternative steps.

The illustrated method includes providing the drain cleaning device 2100 at step 2310. Providing the drain cleaning device 2100 may include providing any of the drain cleaning devices 1200, 1400, 1600, 1700, 1900, 2000 described above. The drain cleaning device 2100 may include, for example, the drum 2115, the cable 2120, the motor 2125, one or more sensors, and the controller 2110. The drain cleaning device 2100 may also include the power supply 2135, the cable feed device 2150, and other suitable components. In some embodiments, such as for the drain cleaning device 1400 shown in FIGS. 6 and 7, the drum 2140 or other components may be omitted At step 2320, the drum 2115 of the drain cleaning device 2100 is rotated by the motor 2125 to spin the cable 2120. Spinning the cable 2120 helps the cable 2120 (or a tool coupled to an end of the cable 2120) cut through clogs and other debris in a conduit. Spinning the cable 2120 also helps the cable fee device 2130 feed the cable 2120 into or out of the drum 2115.

At step 2330, the cable 2120 is extended out of the drum 2115 and into a conduit. The cable 2120 may be manually extended out of the drum 2115 by a user pulling the cable 2120. Alternatively, the cable 2120 may be automatically fed out of the drum 2115 by the cable feed device 2130. Similarly, the cable 2120 may also be fed back into the drum 2115 as the cable 2120 is removed from the conduit At step 2340, a performance characteristic of the drain cleaning device 2100 is detected. More particularly, the performance characteristic is detected while the drain cleaning device 2100 and the cable 2120 are being used (e.g., as the cable 2120 is extended into the conduit). The performance characteristic may be detected by one or more of the sensors 2140, 2145, 2150, 2155. As noted above, the performance characteristic may revolutions per minute of the cable 2120, motor torque, feed speed of the cable 2120, feed direction of the cable 2120, feed force of the cable 2120, stability of the drain cleaning device 2100, or any combination.

At step 2350, an operating parameter of the drain cleaning device 2100 is changed by the controller 2110 based on the performance characteristic detected by the sensors 2140, 2145, 2150, 2155. More particularly, the operating parameter of the motor 2125, the cable feed device 2130, or both may be changed by the controller 2110. For example, the controller 2110 may receive one or more signals from the sensors 2140, 2145, 2150, 2155 indicative of the detected performance characteristic. The controller 2110 may then send an instruction to the motor 2125, the cable feed device 2130, or both to change the operating parameter. As noted above, the operating parameter may be revolutions per minute of the motor 2125, feed speed by the cable feed device 2130, feed direction by the cable feed device 2130, or any combination.

At step 2360, a user is notified of the detected performance characteristic(s) and/or the change in operating parameter(s). The controller 2110 may notify the user of the detected performance characteristic(s) and/or changes in operating parameter(s) through an indicator on the drain cleaning device 2100 or an external device. Such notification may help the user understand why the drain cleaning device 2100 is functioning a certain way.

At seventh step 2370, the detected performance characteristic(s) may be logged in a data log. More particularly, the controller 2100 may send information to an on-board or remote data log to provide information regarding the performance characteristic(s). This data may be used to identify where and when certain events occurred while using the drain cleaning device, such as a distance cleaned, a clog, a bend, or a jam.

Various features and advantages of the invention are set forth in the following claims.

What is claimed is:

1. A drain cleaning device comprising:

a drum;

a cable positioned within the drum, the cable configured to be extended out of the drum and into a conduit;

a motor coupled to the drum to rotate the drum;

a sensor operable to detect a characteristic of the cable; and a controller coupled to the sensor and the motor, the controller configured to:

receive a signal from the sensor indicative of the characteristic of the cable, and send an instruction to the motor to change an operating parameter of the motor based on the signal received from the sensor;

wherein the characteristic of the cable is a type of the cable.

2. The drain cleaning device of claim 1, wherein the characteristic of the cable further includes a size of the cable.

3. The drain cleaning device of claim 1, wherein the operating parameter is a maximum operating speed of the motor.

4. The drain cleaning device of claim 1, wherein the operating parameter is a maximum torque of the motor.

5. The drain cleaning device of claim 1, wherein the operation parameter is a maximum operating speed and a maximum torque of the motor.

6. The drain cleaning device of claim 1, wherein the sensor is supported on the drum.

7. The drain cleaning device of claim 1, further comprising a cable feed device operable to extend the cable out of the drum, wherein the sensor is supported on the cable feed device.

8. The drain cleaning device of claim 1, wherein the sensor is an image sensor.

9. The drain cleaning device of claim 1, wherein the cable includes an RFID tag, and wherein the sensor is an RFID tag reader.

10. The drain cleaning device of claim 1, wherein the controller is further configured to output a signal to notify a user of the characteristic of the cable.

11. The drain cleaning device of claim 10, wherein the controller is configured to output the signal to an external device.

12. A method of operating a drain cleaning device, the method comprising:

providing the drain cleaning device including a drum, a cable positioned within the drum, a motor coupled to the drum, a sensor, and a controller coupled to the sensor and the motor;

rotating the drum with the motor to spin the cable;

extending the cable out of the drum and into a conduit;

detecting, by the sensor, a characteristic of the cable, the characteristic including a type of cable; and changing, by the controller, an operating parameter of the motor based on the characteristic detected by the sensor.

13. The method of claim 12, wherein detecting the characteristic of the cable further includes detecting a size of the cable.

14. The method of claim 12, wherein changing the operating parameter includes setting a maximum operating speed of the motor.

15. The method of claim 12, wherein changing the operating parameter includes setting a maximum torque of the motor.

16. The method of claim 12, wherein changing the operating parameter includes setting a maximum operating speed and a maximum torque of the motor.

17. The method of claim 12, further comprising notifying, by the controller, a user of the characteristic of the cable.

18. A drain cleaning device comprising:

a drum;

a cable positioned within the drum, the cable configured to be extended out of the drum and into a conduit;

a motor coupled to the drum to rotate the drum;

a sensor operable to detect a characteristic of the cable; and a controller coupled to the sensor and the motor, the controller configured to:

receive a signal from the sensor indicative of the characteristic of the cable, and send an instruction to the motor to change an operating parameter of the motor based on the signal received from the sensor, wherein the characteristic of the cable is a size of the cable.

* * * * *